US006273555B1

(12) United States Patent
Hess

(10) Patent No.: US 6,273,555 B1
(45) Date of Patent: Aug. 14, 2001

(54) HIGH EFFICIENCY INK DELIVERY PRINTHEAD HAVING IMPROVED THERMAL CHARACTERISTICS

(75) Inventor: Ulrich E Hess, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/374,637

(22) Filed: Aug. 16, 1999

(51) Int. Cl.[7] ..... B41J 2/05

(52) U.S. Cl. ..... 347/63; 347/56; 165/185; 219/216

(58) Field of Search ..... 347/56, 60, 61, 347/62, 63, 64, 65; 165/185; 219/543, 216; 338/306, 307, 308, 309

(56) References Cited

U.S. PATENT DOCUMENTS

| | | | | |
|---|---|---|---|---|
| 4,383,169 | * | 5/1983 | Ashton | 250/214 VT |
| 4,500,895 | | 2/1985 | Buck et al. . | |
| 4,513,298 | | 4/1985 | Scheu . | |
| 4,535,343 | | 8/1985 | Wright et al. . | |
| 4,574,012 | * | 3/1986 | Oguri et al. | 106/797 |
| 4,616,408 | | 10/1986 | Lloyd . | |
| 4,771,295 | | 9/1988 | Baker et al. . | |
| 4,794,409 | | 12/1988 | Cowger et al. . | |
| 4,809,428 | * | 3/1989 | Aden et al. | 29/611 |
| 4,963,189 | | 10/1990 | Hindagolla . | |
| 5,122,812 | | 6/1992 | Hess et al. . | |
| 5,185,034 | | 2/1993 | Webb et al. . | |
| 5,278,584 | | 1/1994 | Keefe et al. . | |

OTHER PUBLICATIONS

Pending U.S. Patent Application Ser. No. 08/869,446 filed Jun. 05, 1997, of Olsen et al.

Pending U.S. Patent Application Ser. No. 08/873,612 filed Jun. 11, 1997, of Hauck et al.

Pending U.S. Patent Application Ser. No. 08/953,111 filed Oct. 16, 1997, of Etheridge et al.

Hewlett—Packard Journal, vol. 39, No. 4 (Aug. 1998).

Elliot, D. J, *Integrated Circuit Fabrication Technology*, McGraw–Hill Book Company, New York (1982) –(ISBN No. 0–07–019238–3), pp. 1 –40, pp. 43 –85, pp. 125 –143, pp. 165 –229, and pp. 245 –286.

Mrvos, J., et al. "Material Selection and Evaluation for the Lexmark 7000 Printhead", 1988 International Conference on Digital Printing Technologies, *Imaging Science and Technology—Non Impact Printing*, vol. 14, pp. 85 –88 (1988).

CRC Handbook of Chemistry and Physics, 79th edition, 1998, CRC Press LLc, pp. 12–193 to 12–203.*

* cited by examiner

*Primary Examiner*—John Barlow
*Assistant Examiner*—Blaise Mouttet

(57) ABSTRACT

A high efficiency thermal inkjet printhead. The printhead includes a substrate, a base layer on the substrate, and at least one ink expulsion resistor on the base layer. The base layer is made from a special material that experiences a substantial increase in thermal conductivity at the elevated temperatures associated with resistor operation. As a result, the base layer functions as an effective thermal insulator when the resistors are initially energized, yet allows heat to dissipate from the resistors immediately after the deactivation thereof. Numerous benefits are achieved by this development including (1) rapid resistor cool-down between successive ink ejection cycles (which improves the speed/operational frequency of the system); and (2) the prevention of undesired heat dissipation through the base layer when the resistors are initially energized, with the generated heat instead flowing into the ink.

19 Claims, 3 Drawing Sheets

HIGH EFFICIENCY INK DELIVERY PRINTHEAD HAVING IMPROVED THERMAL CHARACTERISTICS

BACKGROUND OF THE INVENTION

The present invention generally relates to ink delivery systems, and more particularly to a thermal inkjet printhead which is characterized by more efficient ink drop expulsion, controlled operating temperatures, high frequency operation, and reduced energy requirements. These goals are accomplished through the use of a novel internal design associated with the printhead as discussed in considerable detail below.

Substantial developments have been made in the field of electronic printing technology. A wide variety of highly-efficient printing systems currently exist which are capable of dispensing ink in a rapid and accurate manner. Thermal inkjet systems are especially important in this regard. Printing units using thermal inkjet technology basically involve an apparatus which includes at least one ink reservoir chamber in fluid communication with a substrate (preferably made of silicon [Si] and/or other comparable materials) having a plurality of thin-film heating resistors thereon. The substrate and resistors are maintained within a structure that is conventionally characterized as a "printhead". Selective activation of the resistors causes thermal excitation of the ink materials stored inside the reservoir chamber and expulsion thereof from the printhead. Representative thermal inkjet systems are discussed in U.S. Pat. Nos. 4,500,895 to Buck et al.; 4,794,409 to Cowger et al.; 4,771,295 to Baker et al.; 5,278,584 to Keefe et al.; and the *Hewlett-Packard Journal,* Vol. 39, No. 4 (August 1988), all of which are incorporated herein by reference.

The ink delivery systems described above (and comparable printing units using thermal inkjet technology) typically include an ink containment unit (e.g. a housing, vessel, or tank) having a self-contained supply of ink therein in order to form an ink cartridge. In a standard ink cartridge, the ink containment unit is directly attached to the remaining components of the cartridge to produce an integral and unitary structure wherein the ink supply is considered to be "on-board" as shown in, for example, U.S. Pat. No. 4,771,295 to Baker et al. However, in other cases, the ink containment unit will be provided at a remote location within the printer, with the ink containment unit being operatively connected to and in fluid communication with the printhead using one or more ink transfer conduits. These particular systems are conventionally known as "off-axis" printing units. Representative, non-limiting off-axis ink delivery systems are discussed in co-owned pending U.S. patent application Ser. No. 08/869,446 (filed on Jun. 5, 1997) entitled "AN INK CONTAINMENT SYSTEM INCLUDING A PLURAL-WALLED BAG FORMED OF INNER AND OUTER FILM LAYERS" (Olsen et al.) and co-owned pending U.S. patent application Ser. No. 08/873,612 (filed Jun. 11, 1997) entitled "REGULATOR FOR A FREE-INK INKJET PEN" (Hauck et al.) which are each incorporated herein by reference. The present invention is applicable to both on-board and off-axis systems which will become readily apparent from the discussion provided below.

Regardless of the particular ink delivery system under consideration, an important factor involves the operating efficiency of the printhead with particular reference to the resistor elements that are used to expel ink on-demand during printhead operation. The term "operating efficiency" shall encompass a number of different items including but not limited to internal temperature levels, operational speed, operating frequency (defined below), energy requirements, and the like. The resistor elements used for ink expulsion (which are produced from a number of compositions including but not limited to a mixture comprised of elemental tantalum [Ta] and elemental aluminum [Al], as well as other comparable materials) are discussed in considerable detail in U.S. Pat. Nos. 4,535,343 to Wright et al.; 4,616,408 to Lloyd; and 5,122,812 to Hess et al. which are all incorporated herein by reference. In accordance with their ability to selectively heat the desired ink compositions so that they can be expelled on-demand from the printhead, the resistors will reach very high peak temperatures, with the term "peak temperature" being defined to involve the maximum operating temperature of the resistor which is typically measured at the end of the electrical impulse that is used to "fire" the resistor and before any cooling occurs. For example, in conventional printhead systems (including those associated with the patents mentioned above), typical peak temperatures experienced by the thin-film resistors will be around 300–1250° C., with such temperatures being reached when the resistor is activated/energized and being present when the "firing impulse" is terminated (before any cooling occurs). These high temperature values will at least partially influence the degree to which the resistors are able to cool down between sequential firing impulses (also characterized herein as "ink ejections".) Typically, the duration between successive firing impulses in a conventional thermal inkjet printhead will be about 20–500 microseconds ($\mu$s), with the duration of each impulse being about 1–8 microseconds ($\mu$s). Thus, only a minimal amount of time is available for the resistors to satisfactorily cool-down, with typical cool-down temperatures being about 60–85° C. as discussed further below.

In accordance with the traditionally high resistor temperatures listed above and the minimal amount of available cool-down time, the overall operating frequency of the resistors in conventional printhead systems is limited. The term "operating frequency" is generally defined herein as the number of times per second that a given resistor is fired (or is able to fire) in a "black-out mode" (e.g. when the resistor is being used at a 100% rate to produce a solid zone of ink on the selected print medium). High operating frequency levels are desirable in a thermal inkjet printing system because they substantially improve printing speed which is usually expressed in pages per minute.

In conventional thermal inkjet systems including but not limited to those discussed in the U.S. patents listed above, (namely, U.S. Pat. Nos. 4,535,343 to Wright et al.; 4,616,408 to Lloyd; and 5,122,812 to Hess which are again incorporated herein by reference), each resistor is separated from the underlying substrate by an electrically-insulating layer of material. This layer (which is classified as a "dielectric" or insulator structure) is normally produced from silicon dioxide ($SiO_2$) having a representative, non-limiting thickness of about 3.5 $\mu$m (see U.S. Pat. No. 4,535,343 to Wright et al.) However, the thermal conductivity of this material does not vary in a significant manner during the temperature fluctuations which occur when the resistors thereon are operating. For reference purposes, the term "thermal conductivity" is defined to involve the heat flow across a surface per unit area per unit time, divided by the negative of the rate of change of temperature with distance in a direction perpendicular to the surface. This definition shall be applicable to the present invention and the various uses of "thermal conductivity" recited herein.

In accordance with the definition of thermal conductivity provided above, the higher the thermal conductivity of a material, the better the material is able to allow the passage of heat therethrough and thereby function as a heat transfer medium. The opposite situation exists in connection with materials having a lower thermal conductivity. Compositions with low thermal conductivity values prevent thermal energy (e.g. heat) from readily passing therethrough and are appropriately characterized as thermal insulators. This information is relevant to the present invention which will become readily apparent from the specific data disclosed in the Detailed Description of Preferred Embodiments section. When each of the resistors in a thermal inkjet printhead is activated using an electrical impulse (e.g. "signal") provided by the main printer unit, it generates sufficient heat to cause "ink bubble nucleation" and expulsion of the ink from the printhead. It is very important that the resulting "left over" heat generated by the resistor once the impulse has ended be rapidly dissipated from the resistor so that proper resistor "cool-down" can occur between impulses. However, between impulses and as the resistor is getting ready to receive the next impulse, it is likewise important that the heat dissipation characteristics of the system be minimized so that little if any heat will be dissipated therefrom when the resistor actually receives the next impulse. As a result, when the next impulse arrives, substantially all of the heat generated by the resistor will be imparted to the ink materials located above the resistor without "leakage" or dissipation of the heat through other parts of the printhead (especially the material layers located below the resistor.) In other words, the heat dissipation characteristics of the system should be "low" when the resistor "turns on" in order to impart substantially all of the heat to the ink (which reduces peak temperature requirements and energy consumption), with the heat dissipation characteristics of the system being "high" when the resistor "turns off" so that proper cooling can take place (which can improve operating frequency as noted above). A printhead which does not function in this manner is characterized by numerous adverse characteristics including but not limited to: (1) the need for increasingly-high resistor "peak" and/or steady-state temperatures in order to compensate for the thermal energy losses outlined above; (2) a reduced operating frequency caused by excessive resistor cool-down time between firing impulses or "ink-expulsions"; and (3) increased energy requirements which are necessary to achieve the higher resistor temperatures described herein. Regarding item (3), these increased energy needs are characterized by a higher "turn-on-energy" (or "TOE") which is defined as the electrical energy required by the resistor to cause an ink droplet (of the proper drop volume) to exit the orifice in the orifice plate (discussed below) at "saturated velocity". Saturated velocity generally involves the maximum possible velocity that the droplet can physically obtain for a given resistor architecture regardless of how much energy is applied to it.

It is particularly important that the thermal energy generated by the resistor elements be rapidly dissipated between successive ink ejections so that adequate resistor cool-down can occur as noted above. A lack of sufficient cool-down (e.g. to a preferred temperature of about 60–85° C. or other comparable value) can cause multiple problems including but not limited to a reduction in operating frequency as previously discussed.

The use of silicon dioxide as a base layer in the printhead does little to control temperature-related problems at the minimum and maximum operating temperatures of the resistors. Instead, it contributes to high resistor peak and steady state temperatures and reduced operating frequency levels. When silicon dioxide is employed as the base layer between the resistors and the substrate, it cannot function as an effective "heat-dissipator" at the high temperatures which exist and remain immediately upon electrical impulse termination. Likewise, at the lower temperatures of the resistors between ink-ejection stages, silicon dioxide is insufficiently insulating to prevent heat loss when the next impulse is received, thereby allowing a substantial amount of heat to be diverted from the ink and dissipated out of the system when the resistor begins its next heating cycle.

Prior to the present invention, a need remained for a thermal inkjet printhead and method for producing the same which avoids the problems listed above. In accordance with the present invention, unique components, materials, and methods are described below which solve the foregoing difficulties in an effective manner. This goal is accomplished through the use of a novel base layer on which the resistor(s) are positioned which is made from a specialized material having a thermal conductivity that varies greatly with temperature in a positive manner. In particular, the claimed base layer has a high thermal conductivity at the elevated temperatures associated with resistor operation and thereby functions as an effective heat-dissipator when the impulses are terminated and the resistors are particularly "hot". This process facilitates proper resistor cool-down and increased operating frequencies. Simultaneously, the claimed base layer is characterized by a reduced thermal conductivity at the lower temperatures associated with the resistors when in an inactive state (e.g. between firing impulses). This reduced thermal conductivity allows the base layer to prevent undesired heat transfer or "leakage" therethrough when the resistors are first energized and "building up" sufficient heat for ink ejection. As a result, the TOE requirements of the system are reduced. Likewise, the claimed system also produces lower peak resistor temperatures as previously described.

In summary, the present invention involves a thermal inkjet printhead having a "self-adjusting" base layer designed to provide the benefits listed above. Also encompassed within the invention are the specialized chemical compositions which can be employed for this purpose, an ink delivery system using the claimed printhead, and a construction method for producing the printhead on a mass production scale. Accordingly, the invention represents a significant advance in thermal inkjet technology which ensures high levels of operating efficiency, excellent image quality, rapid throughput, and increased longevity.

SUMMARY OF THE INVENTION

It is an object of the present invention to provide a highly efficient thermal inkjet printhead which is characterized by improved operating efficiency.

It is another object of the invention to provide a highly efficient thermal inkjet printhead which employs an internal structure that offers improved thermal stability.

It is another object of the invention to provide a highly efficient thermal inkjet printhead which employs at least one or more thin-film heating resistors that are characterized by reduced peak operating temperatures.

It is another object of the invention to provide a highly efficient thermal inkjet printhead which is likewise capable of rapid resistor cool-down between ink-ejection cycles and high frequency operation.

It is a further object of the invention to provide a highly efficient thermal inkjet printhead which is characterized by reduced resistor "turn-on-energy" requirements.

It is a further object of the invention to provide a highly efficient thermal inkjet printhead which employs an internal design that imparts substantially all of the heat generated by the resistors during operation to the ink materials of interest, while avoiding undesired heat dissipation into other printhead components. Likewise, the "self-adjusting" character of the invention allows heat generated by the resistors to efficiently flow out of the system for cooling, purposes between ink-ejection cycles. Improved cooling in this manner provides increased operating frequencies.

It is a further object of the invention to provide a highly efficient thermal inkjet printhead which accomplishes the goals listed above while avoiding any requirement that additional material layers and components be used in the printhead.

It is a further object of the invention to provide a highly efficient thermal inkjet printhead in which the beneficial features thereof yield a printing system that is characterized by rapid operation and the generation of stable printed images.

It is a further object of the invention to provide a highly efficient thermal inkjet printhead in which the claimed structures are readily manufactured using thin-film fabrication techniques on a mass-production scale.

It is a further object of the invention to provide a rapid and effective method for manufacturing a thermal inkjet printhead having the beneficial characteristics, features, and advantages outlined herein.

It is a further object of the invention to provide a rapid and effective method for manufacturing a thermal inkjet printhead having the beneficial characteristics, features, and advantages outlined herein which uses a minimal number of process steps.

It is an even further object of the invention to provide a specialized printhead of the type described above which is readily applicable to a wide variety of different ink delivery systems including (1) on-board cartridge-type units having a self-contained supply of ink associated therewith; and (2) off-axis systems as previously discussed in which the claimed printhead is operatively connected to a remotely-positioned ink containment vessel using one or more tubular conduits.

A novel and highly efficient thermal inkjet printhead is described below which provides numerous advantages over prior systems. As previously stated, the claimed printhead has a "self-adjusting" design that allows heat to be "preserved" and imparted to the ink materials during delivery while permitting extraneous heat to be transferred out of the system between ink delivery cycles. The terms "ink delivery cycles", "firing intervals", "firing cycles", "ink ejection cycles", and other comparable terms shall be considered synonymous and involve the operational stages of the system in which ink is ejected from the printhead in discrete pulses. The goals and benefits achieved by the invention all relate to precise temperature control within the printhead which leads to improved speed and performance. These goals include reduced resistor peak temperature levels (defined above) and diminished energy consumption in the form of lower "turn-on-energy" or "TOE" levels. Reduced resistor temperatures combined with a greater ability to dissipate heat between firing cycles offers added advantages including increased operating frequencies. Finally, lower internal heat levels and decreased operating temperatures enhance the overall structural stability of the claimed printhead, thereby resulting in improved longevity and durability. The claimed invention therefore constitutes a substantial advance in the art of printhead fabrication technology.

As a preliminary point of information, the present invention shall not be restricted to any particular types, sizes, or arrangements of internal printhead components unless otherwise stated herein. Likewise, the numerical parameters listed in this section and the other sections below constitute preferred embodiments designed to provide optimum results and shall not limit the invention in any respect. The claimed invention and its novel developments are applicable to all types of thermal inkjet printing systems provided that they include (1) at least one substrate as discussed below; and (2) at least one ink-ejection resistor element which, when energized, will provide sufficient heat to cause ink materials in proximity therewith to be thermally expelled from the printhead. The claimed invention shall therefore not be considered "resistor specific" and is not limited to any particular applications, uses, and ink compositions. Likewise, the term "resistor element" shall be construed to cover one resistor or groups of multiple resistors.

Regardless of the particular printhead under consideration, it is a primary goal of the invention to control and otherwise stabilize the temperature parameters and heat transfer characteristics of the printhead so that the entire system can operate in a more efficient manner. The considerable benefits associated with this development are outlined herein. For the sake of clarity and in order to adequately explain this invention, specific materials and processes will be recited in the Detailed Description of Preferred Embodiments section with the understanding that these items are being described for example purposes only in a non-limiting fashion.

It should also be understood that the claimed invention shall not be restricted to any particular construction techniques (including any specific material deposition procedures) unless otherwise stated in the Detailed Description of Preferred Embodiments. For example, the terms "forming", "applying", "delivering", "placing", and the like as used throughout this discussion to describe the assembly of the claimed printhead shall broadly encompass any appropriate manufacturing procedures. These processes range from thin-film fabrication techniques to pre-manufacturing the components in question (including the resistor elements) and then adhering these items to the appropriate support structures using one or more adhesive compounds which are known in the art for this purpose. In this regard, the invention shall not be considered "production method specific" unless otherwise stated herein.

As previously noted, a highly effective and durable printhead is provided for use in an ink delivery system. The term "ink delivery system" shall, without limitation, involve a wide variety of different devices including cartridge units of the "self-contained" type having a supply of ink stored therein. Also encompassed within this term are printing units of the "off-axis" variety which employ a printhead connected by one or more conduit members to a remotely-positioned ink containment unit in the form of a tank, vessel, housing, or other equivalent structure. Regardless of which ink delivery system is employed in connection with the claimed printhead, the present invention is capable of providing the benefits listed above which include more efficient and rapid operation.

The following discussion shall constitute a brief and general overview of the invention. More specific details involving particular embodiments, best modes, and other important features of the invention will again be recited in the Detailed Description of Preferred Embodiments section set forth below. All scientific terms used throughout this discussion shall be construed in accordance with the traditional meanings attributed thereto by individuals skilled in the art to which this invention pertains unless a special definition is provided herein.

As previously stated, the claimed invention involves a novel resistor-containing inkjet printhead which is characterized by improved thermal characteristics, namely, more efficient cool-down between ink-ejection cycles, reduced peak operating temperatures, decreased energy requirements (including a diminished resistor "TOE"), and the like. The components and novel features of this system will now be discussed. In order to produce the claimed printhead, a substrate is initially provided which is optimally manufactured from elemental silicon [Si], although the present invention shall not be exclusively restricted to this material with a number of other alternatives being outlined below. Next, a portion of material designated herein as a "base layer" is placed (e.g. deposited) on the substrate, with representative application methods for doing so being discussed in the Detailed Description of Preferred Embodiments section. In addition to functioning as an electrically-insulating or "dielectric" layer between the substrate and the resistor elements, the base layer and the unique materials associated therewith will provide the important benefits listed above which clearly distinguish the present invention from previously-developed systems.

Deposited on the base layer is at least one and preferably multiple thin-film resistors (also designated herein as "resistor elements"). The resistors may be produced from a number of different compositions including but not limited to a mixture of elemental tantalum [Ta] and elemental aluminum [Al] known in the art for resistor fabrication. These structures are designed to expel ink on-demand from the printhead in response to a plurality of electrical impulses delivered thereto which are generated by the printer unit in which the ink delivery system is positioned. As will be discussed in considerable detail below, each electrical impulse (also characterized herein as a "signal") causes the resistor in question to be "energized". Specifically, the application of electrical energy to the resistor results in the generation of heat by this component in accordance with its resistive character. This heat is thereafter imparted to a supply of ink materials located directly above the resistor in a compartment known as a "firing chamber". When the ink materials are heated in this manner, they will expand and be expelled from the printhead. The printhead is then able to generate a printed image from the ink in response to a plurality of successive electrical impulses delivered to the resistor element. During the energization process in which the resistor receives an electrical impulse, the resistor shall be in an "active state". When in an active or "turned on" state, the resistor is at its maximum (peak) temperature and, immediately upon impulse termination, must be able to dissipate heat therefrom so that proper "inter-pulse cooling" can occur. Likewise, between impulses, each of the resistors is in an "inactive state" (which is equivalent to being in an "idle", "stand-by", or "cool-down" mode with no ink expulsion taking place.) At this stage, the resistor in question is at its minimum temperature subsequent to receiving an impulse during a printing operation and is awaiting the next electrical impulse. In particular, the resistor is "turned off" during the foregoing interval. When the next impulse is received, it is important that the resistor be able to impart substantially all of its heat to the ink materials, with heat "leakage" at this stage being undesirable. As the resistors cycle between an active and inactive state (and vice versa), they each experience a significant difference in temperature. The claimed invention takes this difference in temperature into account and "self-adjusts" the system to prevent or promote heat dissipation through the base layer at the appropriate times. Specifically, the novel base layer functions as a thermal insulator immediately before and when the resistor in question is "turned on" by an electrical impulse so that the initial heat generated by this component is entirely transferred into the ink. As a result, the ink expulsion process occurs with improved efficiency and reduced energy requirements. These benefits are achieved by the prevention of undesired heat transfer/dissipation through the base layer which has "self-adjusted" to accomplish this goal. However, when the resistor under consideration is heated to its maximum operating temperature and then "turned off" upon impulse termination, the base layer will again "self-adjust" to allow the passage of residual heat therethrough. This heat is then dissipated and otherwise released from the printhead via the base layer and components thereunder. In this manner, more rapid cool-down of the resistors is accomplished which increases the operating frequency of the system.

With particular reference to the novel base layer of the present invention, it is able to accomplish these goals by having a number of unique characteristics which will now be described in detail. Specifically, the base layer is produced from a material (or combination of materials) which, in the completed base layer, will have a thermal conductivity that increases substantially when the resistor(s) thereon go from an inactive state to an active state as defined above. In accordance with the invention, this increase will involve a multiplication factor which is greater than the multiplication factor provided by silicon dioxide ($SiO_2$). Silicon dioxide is the conventional material that is normally used to produce the base layer. Using traditional calculation and analytical methods, the multiplication factor associated with a base layer made of silicon dioxide between the inactive and active states of the resistor(s) thereon is considered to be about 1.4. However, in accordance with differing methods and accuracy levels for determining this factor (as well as variances in the equipment that is designed to measure thermal conductivity), it shall be stated herein and understood that a novel aspect of the present invention involves the selection of a construction material which has a greater multiplication factor than that associated with silicon dioxide regardless of how this factor is calculated. In situations where the multiplication factor associated with silicon dioxide is determined to be about 1.4 as noted above, the selected material to be employed in connection with the base layer should have a multiplication factor which is greater than 1.4 (and at least about 1.6 in an optimum embodiment). The term "multiplication factor" is specifically defined in accordance with the following formula:

$$TCB_{active}/TCB_{inactive}=X$$

[wherein: (1) $TCB_{active}$=the thermal conductivity of the base layer when the resistors on the base layer are in an active (e.g. energized) state; (2) $TCB_{inactive}$=the thermal conductivity of the base layer when the resistors on the base layer are in an inactive state; and (3) X=the multiplication factor.]

As a result, the base layer will have a lower thermal conductivity when the resistors are in a "resting" or inactive condition so that, immediately upon resistor energization, heat which "builds up" in the resistors for ultimate delivery to the ink will not leak or otherwise dissipate from the system. The base layer will then "self-adjust" to a higher thermal conductivity when the resistor in question is at its peak temperature and then "turned off" so that the remaining heat is effectively dissipated through the base layer for cooling purposes.

In a preferred embodiment which shall not limit the invention in any respect, each resistor in the claimed printhead will ideally have a "first temperature" of about 60–85° C. when the resistor element is in an inactive or cool-down state between electrical impulses. In contrast, each resistor will ideally have a "second temperature" of about 300–1250° C. when the resistor element receives each of the electrical impulses and is "activated". Optimum results are achieved in accordance with the invention if the selected composition in the base layer has a thermal conductivity no greater than about 0.014 watts/cm ° C. when the resistor is at the first temperature and a thermal conductivity of at least about 0.023 watts/cm ° C. when the resistor is at the second temperature. The multiplication factor recited above of about 1.6 (or, in a more general sense, a multiplication factor which is greater than the factor provided by silicon dioxide) is also applicable to the above-listed embodiment in which specific temperatures are recited. While the present invention shall not be limited to the foregoing numerical parameters which are provided as preferred embodiments, they represent values which offer a high degree of effectiveness.

A number of different compositions may be employed in the novel base layer to achieve the benefits listed above. Representative, non-limiting examples of these compositions may be chosen from the following classes of compounds: potassium silicates, lead silicates, ternary carbides, ternary oxides, and ternary nitrides. The selection of particular compositions within these classes which are suitable for use in the present invention will involve some initial, preliminary testing to determine which materials are able to provide the requisite multiplication factor outlined above (e.g. in excess of the multiplication factor associated with silicon dioxide at a minimum). In a preferred embodiment, one particular composition which can, in fact, be used to provide the benefits described above (including the requisite multiplication factor) involves sodium alumino silicate which is discussed with greater specificity in the Detailed Description of Preferred Embodiments section below.

The foregoing examples represent preferred materials and shall not limit the invention in any respect. Likewise, while the claimed products and methods shall not be restricted to any particular numerical parameters unless otherwise specified herein, the base layer will preferably have a uniform and optimum thickness of about 0.5–2.0 $\mu$m. However, the ultimate thickness of the base layer may be varied as needed in accordance with routine preliminary pilot studies involving the particular printhead under consideration and the construction materials associated therewith.

The Detailed Description of Preferred Embodiments section will provide further and more specific data involving the fabrication techniques which may be used to (1) apply or otherwise form the base layer on the substrate; and (2) deliver and fabricate the resistor elements on the base layer. The invention shall not be restricted to any particular fabrication techniques with a number of conventional approaches being applicable as outlined below.

Finally, to complete the printhead construction process, a plate member produced from a metal or polymeric compound having at least one orifice (hole) therethrough is secured in position over and above the resistor elements so that each orifice in the plate member is in axial alignment (e.g. "registry") with at least one of the resistors. The orifices in the plate member are designed to allow ink materials to pass therethrough and out of the printhead.

In accordance with the present invention and the unique "self-adjusting" characteristics of the base layer, an "ink delivery system" is likewise provided in which an ink containment vessel is operatively connected to and in fluid communication with the printhead described above. As extensively discussed in the Detailed Description of Preferred Embodiments section, the term "operatively connected" relative to the printhead and ink containment vessel shall involve a number of different situations including but not limited to (1) cartridge units of the "self-contained" type in which the ink containment vessel is directly attached to the printhead to produce a system having an "on-board" ink supply; and (2) printing units of the "off-axis" variety which employ a printhead connected by one or more conduit members (or similar structures) to a remotely-positioned ink containment unit in the form of a tank, vessel, housing, or other equivalent structure. The novel printhead structures of the present invention shall not be limited to use with any particular ink containment vessels, the proximity of these vessels to the printheads, and the means by which the vessels and printheads are attached to each other.

Finally, the invention shall also encompass a method for producing the claimed "self-adjusting" printheads. The fabrication steps which are used for this purpose involve the materials and components listed above, with the previously-described summary of these items being incorporated by reference in this discussion. The basic production steps are as follows: (1) providing a substrate; (2) placing a base layer on the substrate which is optimally comprised of at least one dielectric composition; and (3) forming at least one resistor element on the base layer for expelling ink on-demand from the printhead. The printhead is designed to generate a printed image from the ink in response to a plurality of successive electrical impulses delivered to the resistor, with the resistor being in an inactive state between each of the electrical impulses and in an active state when each of the electrical impulses is received. In accordance with the novel features of the invention, the dielectric composition in the base layer will have a thermal conductivity which increases by the multiplication factor listed above when the resistor goes from an inactive state to an active state as previously defined, with all of the data provided above concerning this multiplication factor again being incorporated in the present section by reference. The chemical compositions listed above in connection with the base layer are entirely applicable to the claimed method. Likewise, the step of placing the base layer onto the substrate comprises delivering the base layer to the substrate at a preferred thickness range of about 0.5–2.0 $\mu$m (which is again subject to variation as needed in accordance with routine preliminary testing.) Finally, the fabrication process is completed by attaching a plate member having at least one orifice therethrough in position over and above the resistor so that the orifice is in axial alignment (e.g. "registry") with the resistor. The orifice again allows ink materials to pass therethrough and out of the printhead during ink delivery. As a result of this process, the completed printhead will include (1) a substrate; (2) a base layer positioned on the substrate which is produced from at least one dielectric composition having the beneficial characteristics listed above; and (3) at least one resistor element located on the base layer.

The present invention represents a significant advance in the art of thermal inkjet technology and the generation of high-quality images with improved reliability, speed, and longevity. The novel structures, components, and methods described herein offer many important benefits including but not limited to (1) a reduction and stabilization of internal temperature levels within the printhead (with particular reference to the thin-film resistor elements and the peak temperatures associated therewith); (2) increased operating frequency which results in more rapid and effective printhead operation; and (3) reductions in "turn-on-energy" or "TOE" as previously noted. These and other benefits, objects, features, and advantages of the invention will now be discussed in the following Brief Description of the Drawings and Detailed Description of Preferred Embodiments.

BRIEF DESCRIPTION OF THE DRAWINGS

The drawing figures provided below are schematic and representative only. They shall not limit the scope of the invention in any respect. Likewise, reference numbers which are carried over from one figure to another shall constitute common subject matter in the figures under consideration.

DETAILED DESCRIPTION OF PREFERRED EMBODIMENTS

In accordance with the present invention, a high-efficiency thermal inkjet printhead for an ink delivery system is disclosed having improved thermal qualities. The novel printhead is characterized by many important features including reduced peak operating temperatures with particular reference to the resistor elements in the printhead, greater operating frequency, and more effective image generation. The term "thermal inkjet printhead" as used herein shall be broadly construed to encompass, without restriction, any type of printhead having at least one heating resistor therein which is used to thermally excite ink materials for delivery to a print media material. In this regard, the invention shall not be limited to any particular thermal inkjet printhead designs, with many different structures and internal component arrangements being possible provided that they include the resistor structures mentioned above which expel ink on-demand using thermal processes.

Likewise, as previously noted, the claimed printhead is prospectively applicable to many different ink delivery systems including (1) on-board cartridge-type units having a self-contained supply of ink therein which is operatively connected to and in fluid communication with the printhead; and (2) "off-axis" units which employ a remotely-positioned ink containment vessel that is operatively connected to and in fluid communication with the printhead using one or more fluid transfer conduits. The printhead of the present invention shall therefore not be considered "system specific" relative to the ink storage devices associated therewith. To provide a clear and complete understanding of the invention, the following detailed description will be divided into four sections, namely, (1) "A. A General Overview of Thermal Inkjet Technology"; (2) "B. A Review of the Resistor Elements and Associated Structures within the Printhead"; (3) "C. The Novel Thermal Control System of the Present Invention"; and (4) "D. Ink Delivery Systems using the Novel Printhead and Fabrication Methods Associated Therewith".

A. A General Overview of Thermal Inkjet Technology

The present invention is again applicable to a wide variety of ink delivery systems which include (1) a printhead; (2) at least one heating resistor associated with the printhead; and (3) an ink containment vessel having a supply ink therein which is operatively connected to and in fluid communication with the printhead. The ink containment vessel may be directly attached to the printhead or remotely connected thereto in an "off-axis" system as previously discussed using one or more ink transfer conduits. The phrase "operatively connected" as it applies to the printhead and ink containment vessel shall encompass both of these variants and equivalent structures.

Figure 1:
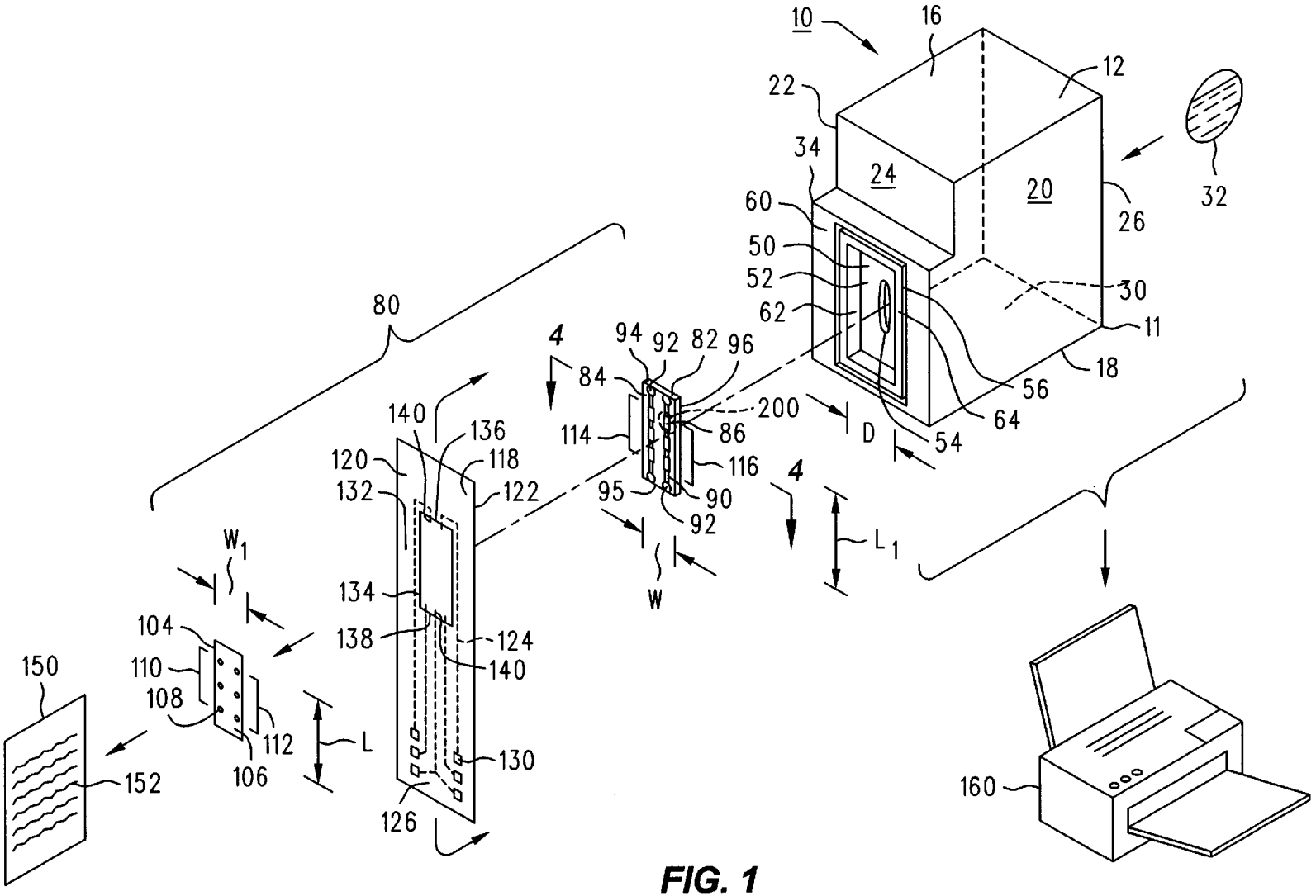
FIG. 1 is a schematically-illustrated, exploded perspective view of a representative ink delivery system in the form of an ink cartridge which is suitable for use with the components and methods of the present invention. The ink cartridge of FIG. 1 has an ink containment vessel directly attached to the printhead of the claimed invention so that an "on-board" ink supply is provided.

To facilitate a complete understanding of the claimed invention, an overview of thermal inkjet technology will now be provided. A representative ink delivery system in the form of a thermal inkjet cartridge unit is illustrated in FIG. 1 at reference number 10. It shall be understood that cartridge 10 is presented herein for example purposes and is non-limiting. Cartridge 10 is shown in schematic format in FIG. 1, with more detailed information regarding cartridge 10 and its various features (as well as similar systems) being provided in U.S. Pat. Nos. 4,500,895 to Buck et al.; 4,794,409 to Cowger et al.; 4,771,295 to Baker et al.; 5,278,584 to Keefe et al.; and the *Hewlett-Packard Journal,* Vol. 39, No. 4 (August 1988), all of which are incorporated herein by reference.

With continued reference to FIG. 1, the cartridge 10 first includes an ink containment vessel 11 in the form of a housing 12. As noted above, the housing 12 shall constitute the ink storage unit of the invention, with the terms "ink containment unit", "housing", "vessel", and "tank" all being considered equivalent from a functional and structural standpoint. The housing 12 further comprises a top wall 16, a bottom wall 18, a first side panel 20, and a second side panel 22. In the embodiment of FIG. 1, the top wall 16 and the bottom wall 18 are substantially parallel to each other. Likewise, the first side panel 20 and the second side panel 22 are also substantially parallel to each other.

The housing 12 additionally includes a front wall 24 and a rear wall 26 which is optimally parallel to the front wall 24 as illustrated. Surrounded by the front wall 24, rear wall 26, top wall 16, bottom wall 18, first side panel 20, and second side panel 22 is an interior chamber or compartment 30 within the housing 12 (shown in phantom lines in FIG. 1) which is designed to retain a supply of an ink composition 32 therein that is either in unconstrained (e.g. "free-flowing") form or retained within a multicellular foam-type structure. Many different materials may be employed in connection with the ink composition 32 without limitation. The claimed invention is therefore not "ink-specific". The ink compositions will first contain at least one coloring agent. Again, this invention shall not be restricted to any particular coloring agents or mixtures thereof. While many different materials may be encompassed within the term "coloring agent", this discussion will focus on both colored and black dye products. Exemplary black dyes that are suitable for use in the ink compositions of interest are listed in U.S. Pat. No. 4,963,189 to Hindagolla which is incorporated herein by reference. Representative colored dye materials are described in the *Color Index,* Vol. 4, 3rd ed., published by The Society of Dyers and Colourists, Yorkshire, England (1971) which is also incorporated herein by reference and is a standard text that is well known in the art. Exemplary chemical dyes listed in the *Color Index,* supra, that are suitable for use herein include but are not limited to the following compositions: C.I. Direct Yellow 11, C.I. Direct Yellow 86, C.I. Direct Yellow 132, C.I. Direct Yellow 142, C.I. Direct Red 9, C.I. Direct Red 24, C.I. Direct Red 227, C.I. Direct Red 239, C.I. Direct Blue 9, C.I. Direct Blue 86, C.I. Direct Blue 189, C.I. Direct Blue 199, C.I. Direct Black 19, C.I. Direct Black 22, C.I. Direct Black 51, C.I. Direct Black 163, C.I. Direct Black 169, C.I. Acid Yellow 3, C.I. Acid Yellow 17, C.I. Acid Yellow 23, C.I. Acid Yellow 73, C.I. Acid Red 18, C.I. Acid Red 33, C.I. Acid Red 52, C.I. Acid Red 289, C.I. Acid Blue 9, C.I. Acid Blue 61:1, C.I. Acid Blue 72, C.I. Acid Black 1, C.I. Acid Black 2, C.I. Acid Black 194, C.I. Reactive Yellow 58, C.I. Reactive Yellow 162, C.I. Reactive Yellow 163, C.I. Reactive Red 21, C.I. Reactive Red 159, C.I. Reactive Red 180, C.I. Reactive Blue 79, C.I. Reactive Blue 216, C.I. Reactive Blue 227, C.I. Reactive Black 5, C.I. Reactive Black 31, C.I. Basic Yellow 13, C.I. Basic Yellow 60, C.I. Basic Yellow 82, C.I. Basic Blue 124, C.I. Basic Blue 140, C.I. Basic Blue 154, C.I. Basic Red 14, C.I. Basic Red 46, C.I. Basic Red 51, C.I. Basic Black 11, and mixtures thereof. These materials are commercially available from many sources including but not limited to the Sandoz Corporation of East Hanover, N.J. (USA), Ciba-Geigy of Ardsley, N.Y. (USA), and others.

The term "coloring agent" shall also encompass pigment dispersions known in the art which basically involve a water-insoluble colorant (namely, a pigment) which is rendered soluble through association with a dispersant (e.g. an acrylic compound). Specific pigments which may be employed to produce pigment dispersions are known in the art, and the present invention shall not be limited to any particular chemical compositions in this regard. Examples of such pigments involve the following compounds which are listed in the *Color Index*, supra: C.I. Pigment Black 7, C.I. Pigment Blue 15, and C.I. Pigment Red 2. Dispersant materials suitable for combination with these and other pigments include monomers and polymers which are also known in the art. An exemplary commercial dispersant consists of a product sold by W.R. Grace and Co. of Lexington, Mass. (USA) under the trademark DAXAD. In a preferred embodiment, the ink compositions of interest will contain about 2–7% by weight total coloring agent therein (whether a single coloring agent or combined coloring agents are used). However, the amount of coloring agent to be employed may be varied as need, depending on the ultimate purpose for which the ink composition is intended and the other ingredients in the ink.

The ink compositions suitable for use in this invention will also include an ink "vehicle" which essentially functions as a carrier medium and main solvent for the other ink components. Many different materials may be used as the ink vehicle, with the present invention not being limited to any particular products for this purpose. A preferred ink vehicle will consist of water combined with other ingredients (e.g. organic solvents and the like). These organic solvents include but are not limited to 2-pyrrolidone, 1,5-pentanediol, N-methyl pyrrolidone, 2-propanol, ethoxylated glycerol, 2-ethyl-2-hydroxymethyl-1,3-propanediol, cyclohexanol, and others known in the art for solvent and/or humectant purposes. All of these compounds may be used in various combinations as determined by preliminary pilot studies on the ink compositions of concern. However, in a preferred embodiment, the ink formulations will contain about 70–80% by weight total combined ink vehicle, wherein at least about 30% by weight of the total ink vehicle will typically consist of water (with the balance comprising any one of the above-listed organic solvents alone or combined). An exemplary ink vehicle will contain about 60–80% by weight water and about 10–30% by weight of one or more organic solvents.

The ink compositions may also include a number of optional ingredients in varying amounts. For example, an optional biocide may be added to prevent any microbial growth in the final ink product. Exemplary biocides suitable for this purpose include proprietary products sold under the trademarks PROXEL GXL by Imperial Chemical Industries of Manchester, England; UCARCID by Union Carbide of Danbury, Conn. (USA); and NUOSEPT by Huls America, Inc. of Piscataway, N.J. (USA). In a preferred embodiment, if a biocide is used, the final ink composition will typically include about 0.05–0.5% by weight biocide, with about 0.30% by weight being preferred.

Another optional ingredient to be employed in the ink compositions will involve one or more buffering agents. The use of a selected buffering agent or multiple (combined) buffering agents is designed to stabilize the pH of the ink formulations if needed and desired. In a preferred embodiment, the optimum pH of the ink compositions will range from about 4–9. Exemplary buffering agents suitable for this purpose include sodium borate, boric acid, and phosphate buffering materials known in the art for pH control. The selection of any particular buffering agents and the amount of buffering agents to be used (as well as the decision to use buffering agents in general) will be determined in accordance with preliminary pilot studies on the particular ink compositions of concern. Additional ingredients (e.g. surfactants) may also be present in the ink compositions if needed. Again, many other ink materials may be employed as the ink composition 32 including those recited in U.S. Pat. No. 5,185,034 which is also incorporated herein by reference.

Referring back to FIG. 1, the front wall 24 also includes an externally-positioned, outwardly-extending printhead support structure 34 which comprises a substantially rectangular central cavity 50. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment 30 through the ink outlet port 54. Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate side walls 62, 64.

With continued reference to FIG. 1, fixedly secured to the housing 12 of the ink cartridge 10 (e.g. attached to the outwardly-extending printhead support structure 34) is a printhead generally designated in FIG. 1 at reference number 80. While the novel features of the printhead 80 will be specifically discussed in the next section, a brief overview of the printhead 80 will now be provided for background information purposes. In accordance with conventional terminology, the printhead 80 actually comprises two main components fixedly secured together (with certain subcomponents positioned therebetween which are also of considerable importance). The first main component used to produce the printhead 80 consists of a substrate 82 preferably manufactured from a number of materials without limitation including silicon [Si], silicon nitride [SiN] having a layer of silicon carbide [SiC] thereon, alumina [$Al_2O_3$], various metals (e.g. elemental aluminum [Al]), and the like. Secured to the upper surface 84 of the substrate 82 using standard thin film fabrication techniques is at least one and preferably a plurality of individually-energizable thin-film resistors 86 (also designated herein as "resistor elements") which function as "ink ejectors". The resistors are typically fabricated from a mixture of elemental tantalum [Ta] and elemental aluminum [Al] known in the art for resistor construction (or other comparable materials which will be discussed in the next section). Only a small number of resistors 86 are shown in the schematic representation of FIG. 1, with the resistors 86 being presented in enlarged format for the sake of clarity. A number of important material layers are likewise present above and below the resistors 86 (including the novel structures of the present invention) which shall be fully described below.

Also provided on the upper surface 84 of the substrate 82 using photolithographic thin-film techniques is a plurality of metallic conductive traces 90 (also designated herein as "bus members", "elongate conductive circuit elements", or simply "circuit elements") which electrically communicate with the resistors 86. The circuit elements 90 likewise communicate with multiple metallic pad-like contact regions 92 positioned at the ends 94, 95 of the substrate 82 on the upper surface 84. The function of all these components which, in combination, are collectively designated herein as a "resistor assembly" 96 will be summarized further below. However, it should be noted that only a small number of circuit elements 90 are illustrated in the schematic representation of FIG. 1 which are again presented in enlarged format for the sake of clarity.

Many different materials and design configurations may be used to construct the resistor assembly 96, with the present invention not being restricted to any particular elements, materials, and structures for this purpose unless otherwise indicated. However, in a preferred, representative, and non-limiting embodiment, the resistor assembly 96 will be approximately 0.5 inches long, and will likewise contain about 300 resistors 86 thus enabling a resolution of about 600 dots per inch ("DPI"). The substrate 82 containing the resistors 86 thereon will preferably have a width "W" (FIG. 1) which is less than the distance "D" between the side walls 62, 64 of the mounting frame 56. As a result, ink flow passageways are formed on both sides of the substrate 82 so that ink flowing from the ink outlet port 54 in the central cavity 50 can ultimately come in contact with the resistors 86. It should also be noted that the substrate 82 may include a number of other components thereon (not shown) depending on the type of ink cartridge 10 under consideration. For example, the substrate 82 may likewise comprise a plurality of logic transistors for precisely controlling operation of the resistors 86, as well as a "demultiplexer" of conventional configuration as discussed in U.S. Pat. No. 5,278,584. The demultiplexer is used to demultiplex incoming multiplexed signals and thereafter distribute these signals to the various thin film resistors 86. The use of a demultiplexer for this purpose enables a reduction in the complexity and quantity of the circuitry (e.g. contact regions 92 and circuit elements 90) formed on the substrate 82.

Securely affixed to the upper surface 84 of the substrate 82 (with a number of intervening material layers therebetween including an ink barrier layer as outlined in the next section) is the second main component of the printhead 80. Specifically, an orifice plate 104 is provided as shown in FIG. 1 which is used to distribute the selected ink compositions to a designated print media material (e.g. paper). In general, the orifice plate 104 consists of a panel member 106 (illustrated schematically in FIG. 1) which is manufactured from one or more metal compositions (e.g. gold-plated nickel [Ni] and the like). In a typical and non-limiting representative embodiment, the orifice plate 104 will have a length "L" of about 5–30 mm and a width "$W_1$" of about 3–15 mm. However, the claimed invention shall not be restricted to any particular orifice plate parameters unless otherwise indicated herein.

The orifice plate 104 further comprises at least one and preferably a plurality of openings or "orifices" therethrough which are designated at reference number 108. These orifices 108 are shown in enlarged format in FIG. 1. Each orifice 108 in a representative embodiment will have a diameter of about 0.01–0.05 mm. In the completed printhead 80, all of the components listed above are assembled so that each orifice 108 is axially aligned (e.g. in substantial registry) with at least one of the resistors 86 on the substrate 82. As result, energization of a given resistor 86 will cause ink expulsion through the desired orifice 108. The claimed invention shall not be limited to any particular size, shape, or dimensional characteristics in connection with the orifice plate 104 and shall likewise not be restricted to any number or arrangement of orifices 108. In an exemplary embodiment as presented in FIG. 1, the orifices 108 are arranged in two rows 110, 112 on the panel member 106 associated with the orifice plate 104. If this arrangement of orifices 108 is employed, the resistors 86 on the resistor assembly 96 (e.g. the substrate 82) will also be arranged in two corresponding rows 114, 116 so that the rows 114, 116 of resistors 86 are in substantial registry with the rows 110, 112 of orifices 108. Further general information concerning this type of metallic orifice plate system is provided in, for example, U.S. Pat. No. 4,500,895 to Buck et al. which is incorporated herein by reference.

It should also be noted for background purposes that, in addition to the systems discussed above which involve metal orifice plates, alternative printing units have effectively employed orifice plate structures constructed from non-metallic organic polymer compositions. These structures typically have a representative and non-limiting thickness of about 1.0–2.0 mils. In this context, the term "non-metallic" will encompass a product which does not contain any elemental metals, metal alloys, or metal amalgams/mixtures. The phrase "organic polymer" wherever it is used in the Detailed Description of Preferred Embodiments section shall involve a long-chain carbon-containing structure of repeating chemical subunits. A number of different polymeric compositions may be employed for this purpose. For example, non-metallic orifice plate members can be manufactured from the following compositions: polytetrafluoroethylene (e.g. Teflon®), polyimide, polymethylmethacrylate, polycarbonate, polyester, polyamide, polyethylene terephthalate, or mixtures thereof. Likewise, a representative commercial organic polymer (e.g. polyimide-based) composition which is suitable for constructing a non-metallic organic polymer-based orifice plate member in a thermal inkjet printing system is a product sold under the trademark "KAPTON" by E.I. du Pont de Nemours & Company of Wilmington, Del. (USA). Further data regarding the use of non-metallic organic polymer orifice plate systems is provided in U.S. Pat. No. 5,278,584 (incorporated herein by reference).

With continued reference to FIG. 1, a film-type flexible circuit member 118 is likewise provided in connection with the cartridge 10 which is designed to "wrap around" the outwardly-extending printhead support structure 34 in the completed ink cartridge 10. Many different materials may be used to produce the circuit member 118, with non-limiting examples including polytetrafluoroethylene (e.g. Teflon®), polyimide, polymethylmethacrylate, polycarbonate, polyester, polyamide, polyethylene terephthalate, or mixtures thereof. Likewise, a representative commercial organic polymer (e.g. polyimide-based) composition which is suitable for constructing the flexible circuit member 118 is a product sold under the trademark "KAPTON" by E.I. du Pont de Nemours & Company of Wilmington, Del. (USA) as previously noted. The flexible circuit member 118 is secured to the printhead support structure 34 by adhesive affixation using conventional adhesive materials (e.g. epoxy resin compositions known in the art for this purpose). The flexible circuit member 118 enables electrical signals to be delivered and transmitted from the printer unit to the resistors 86 on the substrate 82 as discussed below. The film-type flexible circuit member 118 further includes a top surface 120 and a bottom surface 122 (FIG. 1). Formed on the bottom surface 122 of the circuit member 118 and shown in dashed lines in FIG. 1 is a plurality of metallic (e.g. gold-plated copper) circuit traces 124 which are applied to the bottom surface 122 using known metal deposition and photolithographic techniques. Many different circuit trace patterns may be employed on the bottom surface 122 of the flexible circuit member 118, with the specific pattern depending on the particular type of ink cartridge 10 and printing system under consideration. Also provided at position 126 on the top surface 120 of the circuit member 118 is a plurality of metallic (e.g. gold-plated copper) contact pads 130. The contact pads 130 communicate with the underlying circuit traces 124 on the bottom surface 122 of the circuit member 118 via openings or "vias" (not shown) through the circuit member 118. During use of the ink cartridge 10 in a printer unit, the pads 130 come in contact with corresponding printer electrodes in order to transmit electrical control signals or "impulses" from the printer unit to the contact pads 130 and traces 124 on the circuit member 118 for ultimate delivery to the resistor assembly 96. Electrical communication between the resistor assembly 96 and the flexible circuit member 118 will again be outlined below.

Positioned within the middle region 132 of the film-type flexible circuit member 118 is a window 134 which is sized to receive the orifice plate 104 therein. As shown schematically in FIG. 1, the window 134 includes an upper longitudinal edge 136 and a lower longitudinal edge 138. Partially positioned within the window 134 at the upper and lower longitudinal edges 136, 138 are beam-type leads 140 which, in a representative embodiment, are gold-plated copper and constitute the terminal ends (e.g. the ends opposite the contact pads 130) of the circuit traces 124 positioned on the bottom surface 122 of the flexible circuit member 118. The leads 140 are designed for electrical connection by soldering, thermocompression bonding, and the like to the contact regions 92 on the upper surface 84 of the substrate 82 associated with the resistor assembly 96. As a result, electrical communication is established from the contact pads 130 to the resistor assembly 96 via the circuit traces 124 on the flexible circuit member 118. Electrical signals or impulses from the printer unit (not shown) can then travel via the elongate conductive circuit elements 90 on the substrate 82 to the resistors 86 so that on-demand heating (energization) of the resistors 86 can occur.

It is important to emphasize that the present invention shall not be restricted to the specific printhead 80 illustrated in FIG. 1 and discussed above (which is shown in abbreviated, schematic format), with many other printhead designs also being suitable for use in accordance with the invention. The printhead 80 of FIG. 1 is again provided for example purposes and shall not limit the invention in any respect. Likewise, it should also be noted that if a non-metallic organic polymer-type orifice plate system is desired, the orifice plate 104 and flexible circuit member 118 can be manufactured as a single unit as discussed in U.S. Pat. No. 5,278,584.

The last major step in producing the completed printhead 80 involves physical attachment of the orifice plate 104 in position on the underlying portions of the printhead 80 (including the ink barrier layer as discussed below) so that the orifices 108 are in precise alignment with the resistors 86 on the substrate 82. Attachment of these components may likewise be accomplished through the use of conventional adhesive materials (e.g. epoxy and/or cyanoacrylate adhesives known in the art for this purpose) as again outlined in further detail below. At this stage, construction of the ink cartridge 10 is completed. The ink composition 32 may then be delivered on-demand to a selected print media material 150 in order to generate a printed image 152 thereon. Many different compositions may be employed in connection with the print media material 150 including but not limited to paper, plastic (e.g. polyethylene terephthalate and other comparable polymeric compounds), metal, glass, and the like. Furthermore, the cartridge unit 10 may be deployed or otherwise positioned within a suitable printer unit 160 (FIG. 1) which delivers electrical impulses/signals to the cartridge unit 10 so that on-demand printing of the image 152 can take place. Many different printer units can be employed in connection with the ink delivery systems of the claimed invention (including cartridge 10) without restriction. However, exemplary printer units which are suitable for use with the printheads and ink delivery systems of the present invention include but are not limited to those which are manufactured and sold by the Hewlett-Packard Company of Palo Alto, Calif. (USA) under the following product designations: DESKJET 400C, 500C, 540C, 660C, 693C, 820C, 850C, 870C, 1200C, and 1600C.

Figure 2:
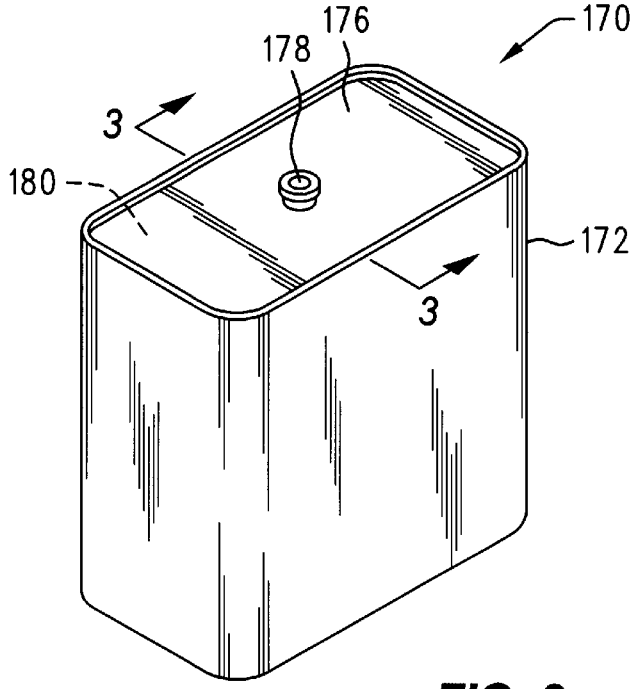
FIG. 2 is a schematically-illustrated perspective view of an ink containment vessel used in an alternative "off-axis"-type ink delivery system which may likewise be operatively connected to the printhead of the present invention.
Figure 3:
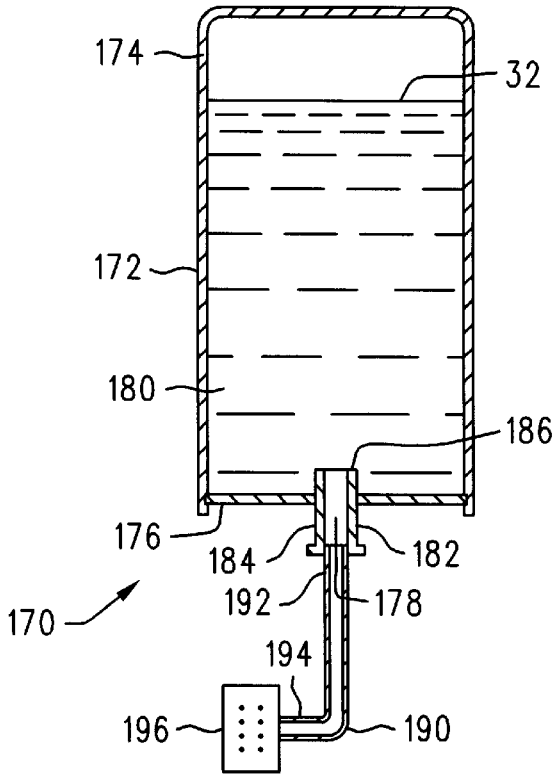
FIG. 3 is a partial cross-sectional view of the ink containment vessel shown in FIG. 2 taken along line 3—3.

The ink cartridge 10 discussed above in connection with FIG. 1 involves a "self-contained" ink delivery system which includes an "on-board" ink supply. The claimed invention may likewise be used with other systems which employ a printhead and a supply of ink stored within an ink containment vessel that is remotely spaced but operatively connected to and in fluid communication with the printhead. Fluid communication is typically accomplished using one or more tubular conduits. An example of such a system (which is known as an "off-axis" apparatus) is again disclosed in co-owned pending U.S. patent application Ser. No. 08/869,446 (filed on Jun. 5, 1997) entitled "AN INK CONTAINMENT SYSTEM INCLUDING A PLURAL-WALLED BAG FORMED OF INNER AND OUTER FILM LAYERS" (Olsen et al.) and co-owned pending U.S. patent application Ser. No. 08/873,612 (filed Jun. 6, 1997) entitled "REGULATOR FOR A FREE-INK INKJET PEN" (Hauck et al.) which are both incorporated herein by reference. As illustrated in FIGS. 2–3, a representative off-axis ink delivery system is shown which includes a tank-like ink containment vessel 170 that is designed for remote operative connection (preferably on a gravity feed or other comparable basis) to a selected thermal inkjet printhead. Again, the terms "ink containment unit", "vessel", "housing", and "tank" shall be considered equivalent in this embodiment. The ink containment vessel 170 is configured in the form of an outer shell or housing 172 which includes a main body portion 174 and a panel member 176 having an inlet/outlet port 178 passing therethrough (FIGS. 2–3). While this embodiment shall not be restricted to any particular assembly methods in connection with the housing 172, the panel member 176 is optimally produced as a separate structure from the main body portion 174. The panel member 176 is thereafter secured to the main body portion 174 as illustrated in FIG. 3 using known thermal welding processes or conventional adhesives (e.g. epoxy resin or cyanoacrylate compounds). However, the panel member 176 shall, in a preferred embodiment, be considered part of the overall ink containment vessel 170/housing 172.

With continued reference to FIG. 3, the housing 172 also has an internal chamber or cavity 180 therein for storing a supply of an ink composition 32. In addition, the housing 172 further includes an upwardly-extending tubular member 182 which passes through the panel member 176 and, in a preferred embodiment, is integrally formed therein. The term "tubular" as used throughout this description shall be defined to encompass a structure which includes at least one or more central passageways therethrough that are surrounded by an outer wall. The tubular member 182 incorporates the inlet/outlet port 178 therein as illustrated in FIG. 3 which provides access to the internal cavity 180 inside the housing 172.

The tubular member 182 positioned within the panel member 176 of the housing 172 has an upper section 184 which is located outside of the housing 172 and a lower section 186 that is located within the ink composition 32 in the internal cavity 180 (FIG. 3.) The upper section 184 of the tubular member 182 is operatively attached by adhesive materials (e.g. conventional cyanoacrylate or epoxy compounds), frictional engagement, and the like to a tubular ink transfer conduit 190 positioned within the port 178 shown schematically in FIG. 3. In the embodiment of FIG. 3, the ink transfer conduit 190 includes a first end 192 which is attached using the methods listed above to and within the port 178 in the upper section 184 of the tubular member 182. The ink transfer conduit 190 further includes a second end 194 that is operatively and remotely attached to a printhead 196 which may involve a number of different designs, configurations, and systems including those associated with printhead 80 illustrated in FIG. 1 which shall be considered equivalent to printhead 196. All of these components are appropriately mounted within a selected printer unit (including printer unit 160) at predetermined locations therein, depending on the type, size, and overall configuration of the entire ink delivery system. It should also be noted that the ink transfer conduit 190 may include at least one optional in-line pump of conventional design (not shown) for facilitating the transfer of ink.

The systems and components presented in FIGS. 1–3 are illustrative in nature. They may, in fact, include additional operating components depending on the particular devices under consideration. The information provided above shall not limit or restrict the present invention and its various embodiments. Instead, the systems of FIGS. 1–3 may be varied as needed and are presented entirely to demonstrate the applicability of the claimed invention to ink delivery systems which employ many different arrangements of components. In this regard, any discussion of particular ink delivery systems, ink containment vessels, and related data shall be considered representative only.

B. A Review of the Resistor Elements and Associated Structures within the Printhead This section will provide a comprehensive discussion for background information purposes of the internal portions of a typical printhead (including the printhead 80 discussed above) with particular reference to the heating resistors and related components. The following description shall not limit the invention in any respect and is provided for example purposes only. Likewise, it shall again be understood that the present invention is prospectively applicable to a wide variety of different thermal inkjet systems and printhead units provided that, at a minimum, they include a substrate and at least one resistor element thereon which is used to selectively heat ink compositions for delivery to a substrate.

Figure 4:
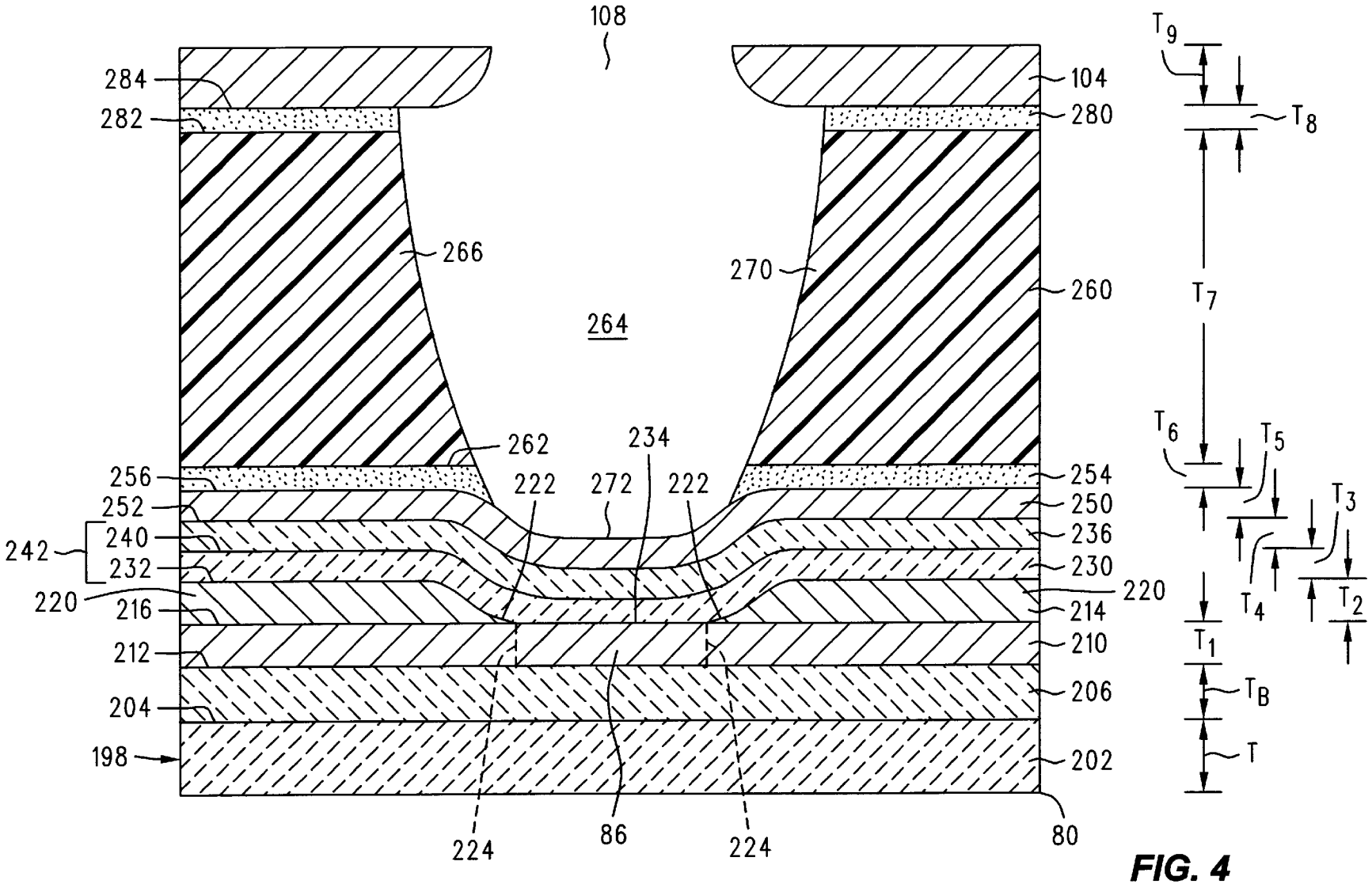
FIG. 4 is a schematically-illustrated, enlarged cross-sectional view of the circled region in FIG. 1 (in an assembled format) taken along line 4—4. This figure illustrates the components of the present invention with particular reference to a representative thin-film resistor element and the material layers thereunder including the novel base layer.

With reference to FIG. 4, a portion 198 of the printhead 80 is cross-sectionally illustrated. For reference purposes, the portion 198 involves the components and structures encompassed within the circled region 200 presented in FIG. 1. The components illustrated in FIG. 4 are shown in an assembled configuration. Likewise, it shall be understood that the various layers presented in FIG. 4 are not necessarily drawn to scale and are enlarged for the sake of clarity. In accordance with the cross-sectional view of FIG. 4, a representative resistor 86 (also characterized herein as a "resistor element" as defined above) is schematically shown along with the various material layers which are positioned above and below the resistor 86 (including the orifice plate 104). All of these structures (and the other layers outlined in this section) are likewise illustrated and fully explained (along with applicable construction techniques) in the following patents which are incorporated herein by reference: U.S. Pat. Nos. 4,535,343 to Wright et al.; 4,616,408 to Lloyd; and 5,122,812 to Hess et al. However, for the sake of clarity and in order to provide a fully enabling disclosure, the following additional information will now be presented.

With continued reference to FIG. 4, the printhead 80 (namely, portion 198) first includes a substrate 202 which is optimally produced from elemental silicon [Si]. The silicon employed for this purpose may be monocrystalline, polycrystalline, or amorphous. Other materials may be used in connection with the substrate 202 without limitation including but not limited to alumina [$Al_2O_3$], silicon nitride [SiN] having a layer of silicon carbide [SiC] thereon, various metals (e.g. elemental aluminum [Al]), and the like (along with mixtures of these compositions). In a preferred and representative embodiment, the substrate 202 will have a thickness "T" of about 500–925 $\mu$m, with this range (and all of the other ranges and numerical parameters presented herein being subject to change as needed in accordance with routine preliminary testing unless otherwise noted). The size of substrate 202 may vary substantially, depending on the type of printhead system under consideration. However, in a representative embodiment (and with reference to FIG. 1), the substrate 202 will have an exemplary width "W" of about 3–15 mm and length "$L_1$" of about 5–40 mm. Incidentally, the substrate 202 in FIG. 4 is equivalent to the substrate 82 discussed above in Section "A", with the substrate 82 being renumbered in this section for the sake of clarity.

Next, positioned on the upper surface 204 of the substrate 202 is a base layer 206 which is designed to electrically insulate the substrate 202 from the resistor 86 as discussed in considerable detail above and to also provide the additional functions recited below in the next section. In accordance with the present invention, the base layer 206 is of novel construction and is specifically produced from a specially-selected dielectric composition having a thermal conductivity which increases significantly when exposed to heightened temperatures. The term "dielectric" as conventionally used herein involves a material which is an electrical insulator or in which an electric field can be maintained with minimum power dissipation. Likewise, the term "thermal conductivity" is again defined in a standard manner to involve the heat flow across a surface per unit area per unit time, divided by the negative of the rate of change of temperature with distance in a direction perpendicular to the surface. Increases in the thermal conductivity of a substance will allow more heat to pass therethrough or otherwise be dissipated within the composition. Decreased thermal conductivity levels provide enhanced thermal insulation properties and the reduced passage of heat through the material of interest.

A number of very important and unexpected benefits are provided by the special base layer 206 including a "self-adjusting" function in which the thermal conductivity of the base layer 206 increases significantly as the temperature of the resistors 86 on the base layer 206 increases. As a result, the base layer 206 functions as a thermal insulator when the resistors 86 are at a minimum, pre-operative temperature and first "turned on" (e.g. upon electrical impulse delivery thereto) so that substantially all of the generated heat can be imparted to the ink. However, when the resistors 86 are heated to their maximum temperature levels, the base layer "self-adjusts" to allow the passage of residual heat therethrough upon impulse termination ("turn off") so that the resistors 86 are rapidly cooled between impulses. In this manner, the peak operating temperatures of the resistors 86 are decreased, operating frequencies are increased, and a reduction in energy consumption occurs. These benefits (along with a more detailed discussion of the novel base layer 206) will be separately provided in the next section (Section "C").

In conventional systems, the base layer 206 was preferably made from silicon dioxide ($SiO_2$) which, as discussed in U.S. Pat. No. 5,122,812, was traditionally formed on the upper surface 204 of the substrate 202 when the surface 204 was produced from silicon [Si]. The silicon dioxide used to form the base layer 206 was fabricated by heating the upper surface 204 to a temperature of about 300–400° C. in a mixture of silane, oxygen, and argon. This process is further discussed in U.S. Pat. No. 4,513,298 to Scheu which is likewise incorporated herein by reference. Thermal oxidation processes and other basic layer formation techniques described herein including chemical vapor deposition (CVD), plasma-enhanced chemical vapor deposition (PECVD), low-pressure chemical vapor deposition (LPCVD), and masking/imaging processes used for layer definition/formation are well known in the art and described in a book entitled Elliott, D. J., *Integrated Circuit Fabrication Technology,* McGraw-Hill Book Company, New York (1982)—(ISBN No. 0-07 -019238-3), pp. 1–40, 43–85, 125–143, 165–229, and 245–286 which is incorporated herein by reference for background information purposes.

Regarding the use of silicon dioxide in connection with the base layer 206, this material is characterized by a relatively low variation in thermal conductivity over the temperature ranges associated with resistor operation. In particular, a base layer 206 manufactured from silicon dioxide will allow substantial amounts of heat to be lost during operation of the resistors 86 and will likewise not permit effective cooling of the resistors 86 between firing cycles. These and other disadvantages associated with silicon dioxide-based systems, as well as the advantages provided by the novel base layer 206 of the present invention (including reduced "turn-on-energy" ["TOE"] requirements and increased operating frequency levels) will be further discussed below.

The remainder of the layers and fabrication stages associated with the printhead 80 illustrated in FIG. 4 are conventional in nature and again discussed in U.S. Pat. Nos. 4,535,343 to Wright et al.; 4,616,408 to Lloyd; and 5,122,812 to Hess et al. With continued reference to FIG. 4, a resistive layer 210 (also characterized herein as a "layer of resistive material") is provided which is positioned/applied on the upper surface 212 of the novel base layer 206 (discussed below). The resistive layer 210 is used to create or "form" the resistors in the system (including the resistor element 86 shown in FIG. 4), with the steps that are employed for this purpose being described later in this section. In a representative and preferred embodiment, the resistive layer 210 (and resistor elements produced therefrom including resistor 86) will have a thickness "$T_1$" of about 500–10000 Å although this value may be varied as needed in accordance with preliminary pilot studies involving the particular printhead under consideration.

A number of different materials may be used to produce the resistive layer 210 without limitation. For example, a representative composition suitable for this purpose includes but is not limited to a mixture of elemental aluminum [Al] and elemental tantalum [Ta] which is known in the art for thin-film resistor fabrication as discussed in U.S. Pat. No. 5,122,812. This material is typically formed by the co-sputtering of elemental aluminum and elemental tantalum onto the upper surface 212 of the base layer 206 (as opposed to the alloying of these materials which involves a different process). In a preferred embodiment, the final mixture which is designated hereinafter as "TaAl" consists of about 40–60 atomic (at.) % tantalum (50 at. %=optimum) and about 40–60 atomic (at.) % aluminum (50 at. %=optimum).

The claimed invention shall not be restricted to any particular materials employed in connection with the resistive layer 210 (and resistors 86 produced therefrom). Instead, a number of different compositions are suitable for this purpose, with the selection of any given resistive material being undertaken in accordance with routine preliminary pilot testing. Other compositions which may be employed as resistive materials in the resistive layer 210 include the following exemplary and non-limiting substances: phosphorous-doped polycrystalline silicon [Si], tantalum nitride [$Ta_2N$], nichrome [NiCr], hafnium bromide [$HfBr_4$], elemental niobium [Nb], elemental vanadium [V], elemental hafnium [Hf], elemental titanium [Ti], elemental zirconium [Zr], elemental yttrium [Y], and mixtures thereof. In accordance with the information provided above, it is important to emphasize that the claimed invention shall not be considered "resistor specific". In addition, the resistive layer 210 can be applied to the upper surface 212 of the base layer 206 using a number of different technologies (depending on the resistive materials under consideration) ranging from sputtering processes when metal materials are involved to the various deposition procedures (including low pressure chemical vapor deposition [LPCVD] methods) which are outlined above and discussed in Elliott, D. J., *Integrated Circuit Fabrication Technology,* McGraw-Hill Book Company, New York (1982)—(ISBN No.0-07-019238-3), pp. 1–40, 43–85, 125–143, 165–229, and 245–286 which is again incorporated herein by reference. For example, as noted in U.S. Pat. No. 5,122,812, LPCVD technology is particularly appropriate for use in applying phosphorous-doped polycrystalline silicon as the resistive material associated with the layer 210. In addition to functioning as an effective resistor material, phosphorous-doped polycrystalline silicon has a rough, yet uniform surface. This type of surface (which is readily repeatable during the manufacturing process) is ideal for the promotion of ink bubble nucleation (bubble formation). Phosphorous-doped polycrystalline silicon is also highly stable at elevated temperatures and avoids oxidation problems which can occur when other resistive materials are employed. Polycrystalline silicon is again preferably applied by the low pressure chemical vapor deposition (LPCVD) of silicon resulting from the decomposition of a selected silicon composition (e.g. silane) diluted by argon as disclosed in U.S. Pat. No. 4,513,298. A typical temperature range for achieving this decomposition is about 600–650° C., and an exemplary deposition rate is about one micron per minute. Doping is achieved using oxide masking and diffusion techniques well known in the art of semiconductor fabrication as discussed in U.S. Pat. No. 4,513,298 and in Elliott, D. J., *Integrated Circuit Fabrication Technology,* McGraw-Hill Book Company, New York (1982)—(ISBN No. 0-07-019238-3), pp. 15–18. However, as previously stated, the claimed invention shall not be restricted to the use of any particular resistive materials or resistor configurations.

In a preferred embodiment designed to produce optimum results, the resistor materials which are employed to manufacture the resistive layer 210/resistor 86 (including those recited above) will generally have a resistivity of about 0.5–2000 $\Omega/ft^2$, although this value may be varied as needed in accordance with preliminary testing involving the construction materials of interest and type of printhead 80 under consideration.

A typical thermal inkjet printhead will contain up to about 300 individual resistors 86 (FIG. 1) or more, depending on the type and overall capacity of the printhead being produced. Although the particular architecture associated with the individual resistors 86 (FIG. 1) in the printhead 80 may be varied considerably as needed in accordance with the type of ink delivery system under consideration, an exemplary resistor 86 (produced from the resistive layer 210) will have a non-limiting length of about 5–100 $\mu$m and a width of about 5–100 $\mu$m. However, the claimed invention shall not be restricted to any given dimensions in connection with the resistors 86 in the printhead 80 or resistive materials associated therewith provided that each completed resistor 86 is able to generate a sufficient amount of heat to expel ink on demand from the ink delivery system of concern. In particular, the selected resistive compounds and resistors 86 produced therefrom should be capable of heating the ink composition 32 to a temperature of at least about 300° C. or higher, depending on the particular apparatus under consideration and the type of ink being delivered.

With continued reference to FIG. 4, formation of an individual resistor 86 from the resistive layer 210 will now be described. Specifically, a conductive layer 214 is positioned on the upper surface 216 of the resistive layer 210. The conductive layer 214 as illustrated in FIG. 4 includes dual portions 220 that are separated from each other. The inner ends 222 of each portion 220 actually form the "boundaries" of the resistor 86 as will be outlined further below. The conductive layer 214 (and portions 220 thereof) are produced from at least one conductive metal placed directly on the upper surface 216 of the resistive layer 210 and patterned thereon using conventional photolithographic, sputtering, metal deposition, and other known techniques as generally discussed in Elliott, D. J., *Integrated Circuit Fabrication Technology,* McGraw-Hill Book Company, New York (1982)—(ISBN No. 0-07-019238-3), pp. 1–40, 43–85, 63–66, 125–143, 165–229, and 245–286. Representative metals (and mixtures thereof) which are suitable for producing the conductive layer 214 will be listed later in this section.

As previously noted and illustrated in FIG. 4, the conductive layer 214 (which is discussed in considerable detail in U.S. Pat. No. 5,122,812) includes dual portions 220 each having inner ends 222. The distance between the inner ends 222 defines the boundaries which create the resistor 86 shown in FIGS. 1 and 4. In particular, the resistor 86 consists of the section of resistive layer 210 that spans (e.g. is between) the inner ends 222 of the dual portions 220 of the conductive layer 214. The boundaries of the resistor 86 are shown in FIG. 4 at dashed vertical lines 224.

As stated in U.S. Pat. No. 5,122,812, the resistor 86 operates as a "conductive bridge" between the dual portions 220 of the conductive layer 214 and effectively links them together from an electrical standpoint. As a result, when electricity in the form of an electrical impulse or signal from the printer unit 160 (discussed above) passes through the "bridge" structure formed by the resistor 86, heat is generated in accordance with the resistive character of the materials which are used to fabricate the resistive layer 210/resistor 86. From a technical standpoint, the presence of the conductive layer 214 over the resistive layer 210 essentially defeats the ability of the resistive material (when covered) to generate significant amounts of heat. Specifically, the electrical current, flowing via the path of least resistance, will be confined to the conductive layer 214, thereby generating minimal thermal energy. Thus, the resistive layer 210 only effectively functions as a "resistor" (e.g. resistor 86) where it is "uncovered" between the dual portions 220 as illustrated in FIG. 4.

The present invention shall not be restricted to any particular materials, configurations, dimensions, and the like in connection with the conductive layer 214 and portions 220 thereof, with the claimed system not being "conductive layer specific". Many different compositions may be used to fabricate the conductive layer 214 including but not limited to the following representative materials: elemental aluminum [Al], elemental gold [Au], elemental copper [Cu], and elemental silicon [Si], with elemental aluminum being preferred. In addition (as outlined in U.S. Pat. No. 5,122,812), the conductive layer 214 may optionally be produced from a specified composition which is doped or combined with various materials or "dopants" including elemental copper and/or elemental silicon (assuming that other compositions are employed as the primary component[s] in the conductive layer 214). If elemental aluminum is used as the main constituent in the conductive layer 214 (with elemental copper being added as a "dopant"), the copper is specifically designed to control problems associated with electromigration. If elemental silicon is used as an additive in an aluminum-based system (either alone or combined with copper), the silicon will effectively prevent side reactions between the aluminum and other silicon-containing layers in the system. An exemplary and preferred material which is used to produce the conductive layer 214 will contain about 95.5% by weight elemental aluminum, about 3.0% by weight elemental copper, and about 1.5% by weight elemental silicon, although the present invention shall not be restricted to this material which is provided for example purposes only. Regarding the overall thickness "$T_2$" of the conductive layer 214 (and dual portions 220 associated therewith as illustrated in FIG. 4), a representative value suitable for this structure will be about 2000–10000 Å. However, all of the information provided above including the preferred thickness ranges, as well as the construction materials listed herein may be varied as needed in accordance with preliminary pilot testing involving the particular ink delivery system under consideration and its desired capabilities.

With continued reference to FIG. 4, positioned over and above the dual portions 220 of the conductive layer 214 and the resistor 86 is a first passivation layer 230. Specifically, the first passivation layer 230 is placed/deposited directly on (1) the upper surface 232 of each portion 220 associated with the conductive layer 214; and (2) the upper surface 234 of the resistor 86. The main function of the first passivation layer 230 is to protect the resistor 86 (and the other components listed above) from the corrosive effects of the ink composition 32 used in the cartridge 10. The protective function of the first passivation layer 230 is of particular importance in connection with the resistor 86 since any physical damage to this structure can dramatically impair its basic operational capabilities. A number of different materials can be employed in connection with the first passivation layer 230 including but not limited to silicon dioxide [$SiO_2$], silicon nitride [SiN], aluminum oxide [$Al_2O_3$], and silicon carbide [SiC]. In a preferred embodiment, silicon nitride is used which is optimally applied using plasma enhanced chemical vapor deposition (PECVD) techniques to deliver the silicon nitride to the upper surface 232 of each portion 220 associated with the conductive layer 214, and the upper surface 234 of the resistor 86. This may be accomplished by using a conventional PECVD system to apply silicon nitride resulting from the decomposition of silane mixed with ammonia at a pressure of about 2 torr and temperature of about 300–400° C. as discussed in U.S. Pat. No. 5,122,812 which is again incorporated herein by reference. While the claimed invention shall not be restricted or otherwise limited to any construction materials or dimensions associated with the first passivation layer 230, the compounds listed above provide best results. Likewise, an exemplary thickness "$T_3$" associated with the first passivation layer 230 is about 1000–10000 Å. This value may nonetheless be varied in accordance with routine preliminary testing involving the particular printhead system under consideration.

Next, in a preferred embodiment designed to provide a maximum degree of protective capability, an optional second passivation layer 236 is positioned directly on the upper surface 240 of the first passivation layer 230 discussed above. The second passivation layer 236 is preferably manufactured from silicon carbide [SiC], although silicon nitride [SiN], silicon dioxide [$SiO_2$], or aluminum oxide [$Al_2O_3$] may also be employed for this purpose in accordance with routine preliminary testing. While a number of different techniques can be used to deposit the second passivation layer 236 on the first passivation layer 230 (as is the case with all of the various material layers discussed herein), plasma enhanced chemical vapor deposition techniques (PECVD) provide optimal results at this stage. If silicon carbide is involved, for example, the PECVD process is accomplished in a representative embodiment by using a combination of silane and methane at a temperature of about 300–450° C. The second passivation layer 236 is again employed to augment the protective capabilities of the first passivation layer 230 by providing an additional chemical barrier to the corrosive effects of the ink composition 32 as previously noted. While the claimed invention shall not be restricted to any particular dimensions in connection with the second passivation layer 236, a representative thickness "$T_4$" for this structure is about 1000–10000 Å. As a result, a highly-effective "dual passivation structure" 242 is provided which consists of (1) the first passivation layer 230; and (2) the second passivation layer 236.

With continued reference to FIG. 4, the next layer in the representative printhead 80 involves an electrically conductive cavitation layer 250 which is applied to the upper surface 252 of the second passivation layer 236. The cavitation layer 250 provides an even further degree of protection regarding the underlying structures in the printhead 80. Specifically, it is used to impart physical damage resistance to the layers of material beneath the cavitation layer 250 in the printhead 80 including but not limited to the first and second passivation layers 230, 236 and the resistor 86 thereunder. In accordance with the protective function of the cavitation layer 250, it is optimally made from a selected metal including but not limited to the following preferred materials: elemental tantalum [Ta], elemental molybdenum [Mo], elemental tungsten [W], and mixtures/alloys thereof. While a number of different techniques can be employed for depositing the cavitation layer 250 in position on the upper surface 252 of the second passivation layer 236, this step is optimally accomplished in accordance with standard sputtering methods and/or other applicable procedures as discussed in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286. Likewise, in a non-limiting exemplary embodiment designed to provide optimum results (which is subject to change in accordance with preliminary pilot testing involving the particular structures under consideration), the cavitation layer 250 has a preferred thickness "$T_5$" of about 1000–6000 Å.

At this stage, a number of additional components are employed within the printhead 80 which will now be discussed with particular reference to FIG. 4. This information is being provided for background information purposes and shall not limit the invention in any respect. As illustrated in FIG. 4 and discussed in U.S. Pat. No. 4,535,343, an optional first adhesive layer 254 is applied in position on the upper surface 256 of the cavitation layer 250 which may involve a number of different compositions without limitation. Representative materials suitable for this purpose include but are not limited to conventional epoxy resin materials, standard cyanoacrylate adhesives, silane coupling agents, and the like. The first adhesive layer 254 is again considered to be "optional" in that a number of the materials which may be employed in connection with the overlying barrier layer (discussed below) will be substantially "self-adhesive" relative to the cavitation layer 250. A decision to use the first adhesive layer 254 shall therefore be determined in accordance with routine preliminary testing involving the particular printhead components under consideration. If used, the first adhesive layer 254 may be applied to the upper surface 256 of the cavitation layer 250 by conventional processes including but not limited to spin coating, roll coating, and other known application materials which are appropriate for this purpose. While the first adhesive layer 254 may be optional in nature, it can be employed as a "default" measure for precautionary reasons to automatically ensure that the overlying barrier layer (discussed below) is securely retained in position. If, in fact, the first adhesive layer 254 is used, it will have an exemplary thickness "$T_6$" of about 100–1000 Å.

Next, a specialized composition is provided within the printhead 80 which is characterized herein as a barrier layer 260. The barrier layer is applied in position on the upper surface 262 of the first adhesive layer 254 (if used) or the upper surface 256 of the cavitation layer 250 if the first adhesive layer 254 is not employed. The barrier layer 260 provides a number of important functions including but not limited to additional protection of the components thereunder from the corrosive effects of the ink composition 32 and the minimization of "cross-talk" between adjacent resistors 86 in the printing system. Of particular interest is the protective function of the barrier layer 260 which electrically insulates the circuit elements 90/resistors 86 (FIG. 1) from each other and other adjacent parts of the printhead 80 so that short circuits and physical damage to these components are prevented. In particular, the barrier layer 260 functions as an electrical insulator and "sealant" which covers the circuit elements 90 and prevents them from coming in contact with the ink materials (ink composition 32 in this embodiment). The barrier layer 260 also protects the components thereunder from physical shock and abrasion damage. These benefits ensure consistent and long-term operation of the printhead 80. Likewise, the architectural features and characteristics of the barrier layer 260 illustrated in FIG. 4 facilitate the precise formation of a discrete "firing chamber" 264 in the printhead 80. The firing chamber 264 involves the particular region within the printhead 80 where ink materials (namely, ink composition 32) are heated by the resistor 86, followed by bubble nucleation and expulsion onto the print media material 150.

Many different chemical compositions may be employed in connection with the barrier layer 260, with high-dielectric organic compounds (e.g. polymers or monomers) being preferred. Representative organic materials which are suitable for this purpose include but are not restricted to commercially-available acrylate photoresist, photoimagable polyimides, thermoplastic adhesives, and other comparable materials that are known in the art for ink barrier layer use. For example, the following representative, non-limiting compounds suitable for fabricating the ink barrier layer 260 are as follows: (1) dry photoresist films containing half acrylol esters of bis-phenol; (2) epoxy monomers; (3) acrylic and melamine monomers [e.g. those which are sold under the trademark "Vacrel" by E.I. DuPont de Nemours and Company of Wilmington, Del. (USA)]; and (4) epoxy-acrylate monomers [e.g. those which are sold under the trademark "Parad" by E.I. DuPont de Nemours and Company of Wilmington, Del. (USA)]. Further information regarding barrier materials is provided in U.S. Pat. No. 5,278,584 and a reference entitled Mrvos, J., et al., "Material Selection and Evaluation for the Lexmark 7000 Printhead", 1998 International Conference on Digital Printing Technologies, *Imagine Science and Technology—Non Impact Printing,* Vol. 14, pp. 85–88 (1998) which are both incorporated herein by reference. The claimed invention shall not be restricted to any particular barrier compositions or methods for applying the barrier layer 260 in position. Regarding preferred application methods, the barrier layer 260 is traditionally delivered by high speed centrifugal spin coating devices, spray coating units, roller coating systems, and the like. However, the particular application method for any given situation will depend on the barrier layer 260 under consideration.

With continued reference to FIG. 4, the barrier layer 260 as cross-sectionally illustrated in this figure consists of two sections 266, 270 which are spaced apart from each other in order to form the firing chamber 264 as discussed above. Positioned at the bottom 272 of the firing chamber 264 is the resistor 86 and layers thereon (including the first passivation layer 230, the second passivation layer 236, and the cavitation layer 250). Heat is imparted to the ink materials (e.g. ink composition 32) within the firing chamber 264 from the resistor 86 through the above-listed layers 230, 236, and 250. While the ultimate thickness and architecture associated with the barrier layer 260 may be varied as needed based on the type of printhead being employed, it is preferred that the barrier layer 260 have a representative, non-limiting thickness "$T_7$" of about 5–30 $\mu$m.

Next, an optional second adhesive layer 280 is provided which is positioned on the upper surface 282 of the barrier layer 260. Representative materials suitable for use in connection with the second adhesive layer 280 include but are not limited to conventional epoxy resin materials, standard cyanoacrylate adhesives, silane coupling agents, and the like. The second adhesive layer 280 is again considered to be "optional" in that a number of the materials which may be employed in connection with the overlying orifice plate 104 (discussed below) will be substantially "self-adhesive" relative to the barrier layer 260. A decision to use the second adhesive layer 280 shall therefore be determined in accordance with routine preliminary testing involving the particular printhead components under consideration. If used, the second adhesive layer 280 may be applied to the upper surface 282 of the barrier layer 260 by conventional processes including but not limited to spin coating, roll coating, and other known application materials which are suitable for this purpose. While the second adhesive layer 280 may be optional in nature, it can be employed as a "default" measure for precautionary reasons to automatically ensure that the overlying orifice plate 104 is securely retained in position. If, in fact, the second adhesive layer 280 is used, it will have an exemplary thickness "$T_8$" of about 100–1000 Å.

It should also be noted that the second adhesive layer 280 may, in fact, involve the use of uncured poly-isoprene photoresist compounds as recited in U.S. Pat. No. 5,278,584 (incorporated herein by reference), as well as (1) polyacrylic acid; or (2) a selected silane coupling agent. The use of silane coupling agents for orifice plate attachment is discussed in co-owned pending U.S. patent application Ser. No. 08/953,111 (filed on Oct. 16, 1997) entitled, "HIGH-DURABILITY RHODIUM-CONTAINING INK CARTRIDGE PRINTHEAD AND METHOD FOR MAKING THE SAME" (Etheridge, et al.) which is incorporated herein by reference. The term "polyacrylic acid" shall be defined to involve a compound having the following basic chemical structure [$CH_2CH(COOH)_n$] wherein n=25–10,000. Polyacrylic acid is commercially available from numerous sources including but not limited to the Dow Chemical Corporation of Midland, Mich. (USA). The aforementioned pending patent application likewise lists a number of silane coupling agents which are suitable for use herein including but not limited to commercial products sold by the Dow Chemical Corporation of Midland, Mich. (USA) [product nos. 6011, 6020, 6030, and 6040], as well as OSI Specialties of Danbury, Conn. (USA) [product no. "Silquest" A-1100]. However, the above-listed materials are again provided for example purposes only and shall not limit the invention in any respect.

Finally, as illustrated in FIG. 4, the orifice plate 104 is secured to the upper surface 284 of the second adhesive layer 280 or on the upper surface 282 of the barrier layer 260 if the second adhesive layer 280 is not employed. In addition to the various materials discussed above in connection with the orifice plate 104 (including the use of a structure made from gold-plated nickel [Ni]), a substantial number of additional compositions can be employed in connection with the orifice plate 104 including metallic structures made of, for example, elemental nickel [Ni] coated with elemental rhodium [Rh] as outlined in co-owned pending U.S. patent application Ser. No. 08/953,111 (filed on Oct. 16, 1997) entitled, "HIGH-DURABILITY RHODIUM-CONTAINING INK CARTRIDGE PRINTHEAD AND METHOD FOR MAKING THE SAME" (Etheridge et al.)

Likewise, the orifice plate 104 can be made from the polymeric compositions outlined in U.S. Pat. No. 5,278,584 (discussed above). As shown in FIG. 4 and previously noted, the orifice 108 in the orifice plate 104 is positioned precisely above the resistor 86 and is in axial alignment (e.g. "registry") therewith so that ink compositions (ink composition 32 in this embodiment) can be effectively expelled from the printhead 80. Likewise, in a preferred and non-limiting embodiment, the orifice plate 104 will have a representative thickness "$T_9$" of about 12–60 $\mu$m.

C. The Novel Thermal Control System of the Present Invention

The novel features and components of the present invention which enable it to provide the benefits listed above will now be discussed. These benefits again include but are not limited to (1) a reduction and stabilization of internal operating temperature conditions within the printhead 80 (with particular reference to the thin-film resistor elements 86); (2) increased operating frequency which results in more rapid and effective printhead operation (with the term "operating frequency" again being defined as the number of times per second that a given resistor 86 is fired [or is able to fire] in a "black-out mode" [e.g. when the resistor 86 is being used at a 100% rate to produce a solid zone of ink on the selected print medium]; and (3) reductions in a parameter known as "turn-on-energy" or "TOE" which again is defined as the electrical energy required by the resistor 86 to cause an ink droplet (of the proper drop volume) to exit the orifice 108 in the orifice plate 104 at "saturated velocity". Saturated velocity generally involves the maximum possible velocity that the droplet can physically obtain for a given resistor architecture regardless of how much energy is applied to it. The benefits associated with a reduced "TOE" value in connection with the resistors 86 in the printhead 80 include reduced overall energy consumption, as well as the ability to maintain the peak resistor temperatures at a relatively low level. All of these goals are achieved in an essentially "automatic" manner as outlined further below which is compatible with the efficient production of thermal inkjet printheads on a mass production scale. The claimed invention therefore represents a significant advance in the art of ink printing technology which ensures high levels of operating efficiency, excellent print quality, and increased longevity.

To accomplish these goals, the base layer 206 is made from a special "self-adjusting" material having a thermal conductivity which increases automatically in response to increased temperatures so that the foregoing benefits can be achieved. As previously noted, the term "thermal conductivity" is basically defined to involve the heat flow across a surface per unit area per unit time, divided by the negative of the rate of change of temperature with distance in a direction perpendicular to the surface. In general, materials with high thermal conductivity levels are better heat-dissipators compared with compositions having lower thermal conductivity values (which will function in a thermally-insulating manner.) The higher the thermal conductivity value of a material, the greater its capacity for allowing heat transfer therethrough (and vice versa).

As described above in the previous section (Section "B"), deposited on the base layer 206 is at least one and preferably multiple thin-film resistors 86 (also designated herein as "resistor elements"). The resistors 86 may be produced from a number of different compositions outlined herein including but not limited to a mixture of elemental tantalum [Ta] and elemental aluminum [Al] known in the art for resistor fabrication. The resistors 86 are again designed to expel ink on-demand from the printhead 80. In turn, the printhead 80 is able to generate a printed image 152 on a print media material 150 (FIG. 1) in response to a plurality of successive electrical impulses (also characterized herein as "signals") delivered to the resistors 86 by the printer unit 160 in which the ink delivery system/cartridge 10 is positioned. Only one electrical impulse is typically needed to cause a given resistor 86 to "fire" or eject ink from the printhead 80. The term "plurality of successive electrical impulses" involves a situation in which individual electrical impulses are delivered to the resistor 86 of interest in rapid succession (e.g. one after another, with speed and time parameters being outlined below). Each electrical impulse will cause a droplet of the ink composition 32 to be expelled from the printhead 80, with a "succession" of such impulses being employed to generate a plurality of droplets which create the overall printed image 152. In this regard, the term "plurality of successive electrical impulses" shall not be construed to limit this invention to a situation where more than one impulse is required to cause a given resistor 86 to fire. Instead, the multiple impulses described above generate successive ink droplets or "firings" which create the composite printed image 152.

The delivery of each electrical impulse (which constitutes a discrete quantity of electrical energy) to the resistor 86 in question causes it to be "energized". As a result, the resistor 86 generates heat in accordance with its resistive character. This heat is thereafter imparted to the ink materials (e.g. ink composition 32) directly above the resistor 86 in the firing chamber 264. Specifically, the heat passes through the material layers positioned above the resistor 86 including the first passivation layer 230, the second passivation layer 236, and the cavitation layer 250. When the ink materials are heated in this manner, they will expand and be expelled from the printhead 80 as discussed above and in the *Hewlett-Packard Journal,* Vol. 39, No. 4 (August 1988) which is incorporated herein by reference. During the energization process in which the resistor 86 receives an electrical impulse, the resistor 86 shall be in an "active state". When in an active or "turned on" state, the resistor 86 is at its maximum or "peak" operating temperature and, immediately upon impulse termination, must be able to dissipate heat therefrom so that proper "inter-pulse cooling" can occur. Likewise, between impulses, each resistor 86 is in an "inactive state" (which is equivalent to being in an "idle", "stand-by", or "cool-down" mode with no ink expulsion taking place.) At this stage, the resistor 86 in question is at its minimum temperature subsequent to receiving an impulse during a printing operation and is awaiting the next electrical impulse. In particular, the resistor 86 is "turned off" during the foregoing interval. When the next impulse is received, it is important that the resistor 86 be able to impart substantially all of its heat to the ink materials (e.g. ink composition 32), with heat "leakage" at this stage being undesirable. As the resistors 86 cycle between an inactive and active state (and vice versa), they each experience a significant difference in temperature. The claimed invention takes this difference in temperature into account and "self-adjusts" the system to prevent or promote heat dissipation through the base layer 206 at the appropriate times. Specifically, the novel base layer 206 functions as a thermal insulator immediately before and when the resistor 86 in question is "turned on" by an electrical impulse so that the initial heat generated by this component is entirely transferred into the ink. As a result, the ink expulsion process occurs with improved efficiency and reduced energy requirements. These benefits are achieved by the prevention of undesired heat transfer/dissipation through the base layer 206 which has "self-adjusted" to accomplish this goal. However, when the resistor 86 under consideration is heated to its maximum operating temperature and then "turned off" upon impulse termination, the base layer 206 will again "self-adjust" to allow the passage of residual heat therethrough. This heat is then dissipated and otherwise released from the printhead 80 via the base layer 206 and components thereunder. In this manner, more rapid cool-down of the resistors 86 is accomplished which increases the operating frequency of the system. Likewise, in accordance with the process outlined above, the peak operating temperature of the resistors 86 is reduced, with "peak operating temperature" being defined above to involve the maximum operating temperature of the resistor 86 in question which is typically measured at the end of the electrical impulse that is used to "fire" the resistor 86 and before any cooling occurs. In particular, even after the electrical impulse in question has terminated, the resistor 86 will remain at or near the foregoing temperature until cooling begins (which is accelerated by the claimed invention).

The specialized materials recited in this section which are used to produce the base layer 206 are distinguishable from the prior composition that was typically employed for this purpose, namely, silicon dioxide ($SiO_2$). In particular, the compositions discussed herein (and the present invention in general) are able to provide a greater increase in thermal conductivity when exposed to increasing temperature levels compared with silicon dioxide. This aspect of the claimed invention and the "self-adjusting" capabilities of the novel base layer 206 will now be discussed.

Specifically, the base layer 206 is produced from a material (or combination of materials) which, in the completed base layer 206, will have a thermal conductivity that increases substantially when the resistor(s) 86 thereon go from an inactive state to an active state as defined above. In accordance with the invention, this increase will involve a multiplication factor which is greater than the multiplication factor provided by silicon dioxide ($SiO_2$). Silicon dioxide is the conventional material that is normally used to produce the base layer 206 as previously discussed. Using traditional calculation and analytical methods, the multiplication factor associated with a base layer 206 made of silicon dioxide between the inactive and active states of the resistor(s) 86 thereon is considered to be about 1.4. However, in accordance with differing methods and accuracy levels for determining this factor (as well as variances in the equipment that is designed to measure thermal conductivity), it shall be stated herein and understood that a novel aspect of the present invention involves the selection of a base layer 206 construction material which has a greater multiplication factor than that associated with silicon dioxide regardless of how this factor is calculated. In situations where the multiplication factor associated with silicon dioxide is determined to be about 1.4 as noted above, the selected material to be employed in connection with the base layer 206 should have a multiplication factor that is greater than 1.4 (and at least about 1.6 in an optimum embodiment). The term "multiplication factor" is specifically defined in accordance with the following formula:

$$TCB_{active}/TCB_{inactive}=X$$

[wherein: (1) $TCB_{active}$=the thermal conductivity of the base layer 206 when the resistors 86 on the base layer 206 are in an active (e.g. energized) state; (2) $TCB_{inactive}$=the thermal conductivity of the base layer 206 when the resistors 86 on the base layer 206 are in an inactive state; and (3) X=the multiplication factor.]

As a result, the base layer 206 will have a lower thermal conductivity when the resistors 86 are in a "resting" or inactive condition so that, immediately upon resistor 86 energization, heat which "builds up" in the resistors 86 for ultimate delivery to the ink 32 will not leak or otherwise dissipate from the system. The base layer 206 will then "self-adjust" to a higher thermal conductivity when the resistor 86 in question is at its peak temperature and then "turned off" so that the remaining heat is effectively dissipated through the base layer 206 for cooling purposes.

In a preferred embodiment which shall not limit the invention in any respect, each resistor 86 in the claimed printhead 80 will ideally have a "first temperature" of about 60–85° C. when the resistor 86 is in an inactive or cool-down state between electrical impulses. In contrast, each resistor 86 will ideally have a "second temperature" of about 300–1250° C. when the resistor 86 receives each of the electrical impulses and is "activated". Optimum results are achieved in accordance with the invention if the selected composition in the novel base layer 206 has a thermal conductivity no greater than about 0.014 watts/cm ° C. when the resistor 86 is at the first temperature and a thermal conductivity of at least about 0.023 watts/cm ° C. when the resistor 86 is at the second temperature. The preferred multiplication factor recited above of about 1.6 (or, in a more general sense, a multiplication factor which is greater than the multiplication factor provided by silicon dioxide) is also applicable to the above-listed embodiment in which specific temperatures are recited. While the present invention shall not be limited to the foregoing numerical parameters which are provided as preferred embodiments, they represent values which offer a high degree of effectiveness.

A number of different compositions may be employed in the novel base layer 206 to achieve the benefits listed above. Representative, non-limiting examples of these compositions may be chosen from the following classes of compounds: potassium silicates, lead silicates, ternary carbides, ternary oxides, and ternary nitrides. The selection of particular compositions within these classes which will be suitable for use in the present invention will involve some initial, preliminary testing to determine which materials are able to provide the requisite multiplication factor outlined above (e.g. in excess of the multiplication factor associated with silicon dioxide at a minimum). However, the above-listed classes of compounds offer the greatest promise in the present invention and have been selected for this purpose because of their potential for providing high thermal conductivity values at high resistor operating temperatures and low thermal conductivity values under low temperature conditions. In a preferred embodiment, one particular composition which may, in fact, be used to provide the benefits described above (including the requisite multiplication factor greater than that associated with silicon dioxide) involves sodium alumino silicate. This material has the following formula: $SiO_2$—$Al_2O_3$—$Na_2O$ wherein each of the constituents (e.g. $SiO_2$, $Al_2O_3$, and $Na_2O$) may be varied proportionwise as needed and desired as long as at least some of each constituent is present. A representative commercial source from which sodium alumino silicate is available is Watson, Phillips y Cía. Sucs., S.A. de C.V. of Naucalpan, Edo. de Mex, Mexico.

The foregoing examples represent preferred materials and shall not limit the invention in any respect. Likewise, while the claimed products and methods shall not be restricted to any particular numerical parameters unless otherwise specified herein, the novel base layer 206 will preferably have a uniform and optimum thickness "$T_B$" (FIG. 4) of about 0.5–2.0 μm. However, the ultimate thickness of the base layer 206 may be varied as needed in accordance with routine preliminary pilot studies involving the particular printhead under consideration and the construction materials associated therewith. Likewise, a multiplication factor (defined above) which is greater than that associated with silicon dioxide by any amount (even if small) will be beneficial. As a result, the base layer 206 will have a lower thermal conductivity when the resistor 86 is in a "resting" or inactive condition so that, immediately upon resistor 86 energization, heat which "builds up" in the resistor 86 for ultimate delivery to the ink will not "leak" or otherwise dissipate from the system. The base layer 206 will then "self-adjust" to a higher thermal conductivity when the resistor 86 is at its peak temperature and then "turned off" so that the remaining heat is effectively dissipated through the base layer 206 for cooling purposes.

Regardless of which temperatures are experienced by the resistors 86 when in the inactive and active states, it is a main goal of the invention to provide a base layer 206 having a thermal conductivity which increases by the multiplication factor listed above between the inactive and active states of the resistors 86, with this factor providing substantial benefits throughout a wide variety of temperature levels. For reference purposes, it should also be noted that the duration between successive electrical impulses in a conventional thermal inkjet printhead is about 20–500 microseconds (μs), with the duration of each impulse being about 1–8 microseconds (μs). Thus, only a minimal amount of time is available for the resistors 86 to satisfactorily cool-down (with typical cool-down temperatures being about 60–85° C. as stated above). However, in accordance with the novel base layer 206 described herein, rapid and effective cool-down occurs in a reduced amount of time compared with conventional printhead devices.

Finally, numerous deposition methods may be employed in connection with the compositions recited in this section which are used to produce the novel base layer 206. Thermal oxidation processes and other basic layer formation techniques including chemical vapor deposition (CVD), plasma-enhanced chemical vapor deposition (PECVD), low-pressure chemical vapor deposition (LPCVD), sputtering, and standard masking/imaging processes used for layer definition can be employed in connection with the novel base layer 206. These techniques are well known in the art and again described in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286.

Use of the novel base layer 206 again provides many important benefits compared with base layers that employ conventional materials (e.g. silicon dioxide) including but not limited to: (A) a reduction in the peak operating temperature of the resistors 86 by an amount equal to at least about 5%; and (B) an improvement in operating frequency as defined above of at least about 10%. While these values shall be characterized as "typical", actual values in any given situation using the present invention may be more or less than those listed above, depending on the composition that is ultimately selected for use in the base layer 206 and the "conventional" material(s) that it is being compared with. However, regardless of which "self-adjusting" composition is employed in the novel base layer 206, it will provide at least some noteworthy improvement in the parameters listed above compared with known construction compositions, with any improvement being beneficial. In this regard, the claimed invention represents a substantial advance in the art of thermal inkjet technology which contributes to a greater degree of operational efficiency, print quality, and longevity.

D. Ink Delivery Systems using the Novel Printhead and Fabrication Methods Associated Therewith In accordance with the information provided above, a unique printhead 80 having a high degree of thermal stability and efficiency is disclosed. The benefits associated with this structure (which are provided by the novel base layer 206) are summarized in the previous sections. In addition to the components described herein, this invention shall also encompass (1) an "ink delivery system" which is constructed using the claimed printhead 80; and (2) a novel method for fabricating the printhead 80 which employs the specialized components listed in Sections "A"–"C" above. Accordingly, all of the data in Sections "A"–"C" shall be incorporated by reference in the present section (Section "D").

In order to produce the ink delivery system of the present invention, an ink containment vessel is provided which is operatively connected to and in fluid communication with the claimed printhead 80. The term "ink containment vessel" is defined above and can involve any type of housing, tank, or other structure designed to hold a supply of ink therein (including the ink composition 32). The terms "ink containment vessel", "housing", "chamber", and "tank" shall all be considered equivalent from a functional and structural standpoint. The ink containment vessel can involve, for example, the housing 12 employed in the self-contained cartridge 10 of FIG. 1 or the housing 172 associated with the "off-axis" system of FIGS. 2–3. Likewise, the phrase "operatively connected" shall encompass a situation in which the claimed "self-adjusting" printhead 80 is directly attached to an ink containment vessel as shown in FIG. 1 or remotely connected to an ink containment vessel in an "off-axis" manner as illustrated in FIG. 3. Again, an example of an "on-board" system of the type presented in FIG. 1 is provided in U.S. Pat. No. 4,771,295 to Baker et al., with "off-axis" ink delivery units being described in co-owned pending U.S. patent application Ser. No. 08/869,446 (filed on Jun. 5, 1997) entitled "AN INK CONTAINMENT SYSTEM INCLUDING A PLURAL-WALLED BAG FORMED OF INNER AND OUTER FILM LAYERS" (Olsen et al.) and co-owned pending U.S. patent application Ser. No. 08/873,612 (filed Jun. 11, 1997) entitled "REGULATOR FOR A FREE-INK INKJET PEN" (Hauck et al.), with all of these applications and patents being incorporated herein by reference. These references describe and support "operative connection" of the claimed printhead (e.g. printhead 80 or 196) to a suitable ink containment vessel, with the data and benefits recited in Sections "A"–"C" again being incorporated by reference in the current section (Section "D"). This data includes representative construction materials and parameters associated with the base layer 206. Also, the claimed ink delivery system will further include an orifice plate 104 having at least one orifice 108 therein which is secured in position over and above the resistor 86 (FIG. 4) in the printhead 80 so that the orifice 108 in the orifice plate 104 is in axial alignment with the resistor 86. Again, the orifice 108 is designed to allow ink materials to pass therethrough and out of the printhead 80 during operation thereof.

In accordance with the claimed method, a substrate 202 of the type described in Sections "A"–"B" is initially provided.

The novel base layer 206 is thereafter placed on the substrate 202, with the base layer 206 being made from the specialized materials listed above, namely, those which have the numerical values and parameters recited in Section "C". These materials enable the base layer 206 to be "self-adjusting" so that the thermal conductivity of this structure will substantially increase with increased resistor temperatures. In a preferred embodiment, the base layer 206 will be applied/delivered to the substrate 202 at a non-limiting thickness "$T_B$" of about 0.5–2.0 $\mu$m although this range may be varied as needed in accordance with preliminary pilot testing. Application methods that are suitable for this step, resistor formation, and other related processes are outlined in Sections "A"–"C" and in Elliott, D. J., *Integrated Circuit Fabrication Technology,* McGraw-Hill Book Company, New York (1982)—(ISBN No. 0-07-019238-3), pp. 1–40, 43–85, 125–143, 165–229, and 245–286. Thereafter, at least one resistor 86 is formed on the base layer 206 which is designed to expel ink on-demand from the printhead 80. Data involving the resistor 86 (and fabrication methods associated therewith) is again provided in Sections "A"–"B" above. Finally, an orifice plate 104 having at least one orifice 108 therethrough is attached in position over and above the resistor 86 in the printhead 80 (FIG. 4) so that the orifice 108 is in axial alignment with the resistor 86. The orifice 108 again allows the ink composition of interest to pass therethrough and out of the printhead 80 during operation thereof. Further data involving the orifice plate 104 and preferred attachment methods are provided in Section "B".

In conclusion, the present invention involves a novel printhead structure which is characterized by many benefits. As previously noted, these benefits include (1) a reduction and stabilization of internal operating temperature conditions within the printhead (with particular reference to the thin-film resistor elements); (2) increased operating frequency which results in more rapid and effective printhead operation; and (3) reductions in "turn-on-energy" or "TOE" as outlined above. All of these goals are achieved in a manner which is compatible with the efficient fabrication of thermal inkjet printheads and ink delivery systems on a mass production scale. Having herein set forth preferred embodiments of the invention, it is anticipated that suitable modifications may be made thereto by individuals skilled in the relevant art which nonetheless remain within the scope of the invention. For example, the invention shall not be limited to any particular ink delivery systems, operational parameters, numerical values, dimensions, ink compositions, and component orientations within the general guidelines set forth above unless otherwise stated herein. The present invention shall therefore only be construed in accordance with the following claims:

The invention that is claimed is:

1. A high efficiency ink delivery printhead having improved thermal characteristics comprising:

a substrate;

a base layer positioned on said substrate; and at least one resistor element positioned on said base layer for expelling ink on-demand from said printhead, said printhead generating a printed image from said ink in response to a plurality of electrical impulses delivered to said resistor element, said resistor element being in an inactive state between each of said electrical impulses and in an active state upon receipt of each of said electrical impulses, said base layer being comprised of a material having a thermal conductivity that increases by a multiplication factor which is greater than that provided by silicon dioxide when said resistor element on said base layer goes from said inactive state to said active state.

2. The printhead of claim 1 wherein said base layer has a thickness of about 0.5–2.0 $\mu$m.

3. The printhead of claim 1 wherein said resistor element has a first temperature of about 60–85° C. when said resistor element is in said inactive state between each of said electrical impulses, and said resistor element has a second temperature of about 300–1250° C. when said resistor element receives each of said electrical impulses, said material used to produce said base layer having a thermal conductivity no greater than about 0.014 watts/cm ° C. when said resistor element is at said first temperature and a thermal conductivity of at least about 0.023 watts/cm ° C. when said resistor element is at said second temperature.

4. The printhead of claim 1 further comprising a plate member having at least one orifice therethrough which is secured in position over and above said resistor element so that said orifice in said plate member is in axial alignment with said resistor element, said orifice allowing said ink to pass therethrough and out of said printhead during operation thereof.

5. A high efficiency ink delivery printhead having improved thermal characteristics comprising:

a substrate;

a base layer positioned on said substrate, said base layer being comprised of sodium alumino silicate; and at least one resistor element positioned on said base layer for expelling ink on-demand from said printhead.

6. The printhead of claim 5 wherein said base layer has a thickness of about 0.5–2.0 $\mu$m.

7. The printhead of claim 5 further comprising a plate member having at least one orifice therethrough which is secured in position over and above said resistor element so that said orifice in said plate member is in axial alignment with said resistor element, said orifice allowing said ink to pass therethrough and out of said printhead during operation thereof.

8. An ink delivery system for use in generating printed images comprising:

a printhead comprising:

a substrate;

a base layer positioned on said substrate; and at least one resistor element positioned on said base layer for expelling ink on-demand from said printhead, said printhead generating a printed image from said ink in response to a plurality of electrical impulses delivered to said resistor element, said resistor element being in an inactive state between each of said electrical impulses and in an active state upon receipt of each of said electrical impulses, said base layer being comprised of a material having a thermal conductivity that increases by a multiplication factor which is greater than that provided by silicon dioxide when said resistor element goes from said inactive state to said active state; and an ink containment vessel operatively connected to and in fluid communication with said printhead.

9. The ink delivery system of claim 8 wherein said base layer in said printhead has a thickness of about 0.5–2.0 $\mu$m.

10. The ink delivery system of claim 8 wherein said resistor element in said printhead has a first temperature of about 60–85° C. when said resistor element is in said inactive state between each of said electrical impulses, and said resistor element has a second temperature of about 300–1250° C. when said resistor element receives each of said electrical impulses, said material used to produce said base layer having a thermal conductivity no greater than about 0.014 watts/cm ° C. when said resistor element is at said first temperature and a thermal conductivity of at least about 0.023 watts/cm ° C. when said resistor element is at said second temperature.

11. The ink delivery system of claim 8 wherein said printhead further comprises a plate member having at least one orifice therethrough which is secured in position over and above said resistor element so that said orifice in said plate member is in axial alignment with said resistor element, said orifice allowing said ink to pass therethrough and out of said printhead during operation thereof.

12. An ink delivery system for use in generating printed images comprising:

a printhead comprising:

a substrate;

a base layer positioned on said substrate, said base layer being comprised of sodium alumino silicate; and at least one resistor element positioned on said base layer for expelling ink on-demand from said printhead; and an ink containment vessel operatively connected to and in fluid communication with said printhead.

13. The ink delivery system of claim 12 wherein said base layer in said printhead has a thickness of about 0.5–2.0 $\mu$m.

14. The ink delivery system of claim 12 wherein said printhead further comprises a plate member having at least one orifice therethrough which is secured in position over and above said resistor element so that said orifice in said plate member is in axial alignment with said resistor element, said orifice allowing said ink to pass therethrough and out of said printhead during operation thereof.

15. A method for fabricating a high efficiency printhead having improved thermal characteristics for use in an ink delivery system comprising:

providing a substrate;

placing a base layer on said substrate; and forming at least one resistor element on said base layer for expelling ink on-demand from said printhead, said printhead generating a printed image from said ink in response to a plurality of electrical impulses delivered to said resistor element, said resistor element being in an inactive state between each of said electrical impulses and in an active state upon receipt of each of said electrical impulses, said base layer being comprised of a material having a thermal conductivity that increases by a multiplication factor which is greater than that provided by silicon dioxide when said resistor element goes from said inactive state to said active state.

16. The method of claim 15 further comprising attaching a plate member having at least one orifice therethrough in position over and above said resistor element so that said orifice in said plate member is in axial alignment with said resistor element, said orifice allowing said ink to pass therethrough and out of said printhead during operation thereof.

17. A method for fabricating a high efficiency printhead having improved thermal characteristics for use in an ink delivery system comprising:

providing a substrate;

placing a base layer on said substrate, said base layer being comprised of sodium alumino silicate; and forming at least one resistor element on said base layer for expelling ink on-demand from said printhead.

18. The method of claim 17 further comprising attaching a plate member having at least one orifice therethrough in position over and above said resistor element so that said orifice in said plate member is in axial alignment with said resistor element, said orifice allowing said ink to pass therethrough and out of said printhead during operation thereof.

19. The method of claim 17 wherein said placing of said base layer on said substrate comprises delivering said base layer thereto at a thickness of about 0.5–2.0 $\mu$m.

* * * * *